US012752145B2

(12) United States Patent
Midha et al.

(10) Patent No.: US 12,752,145 B2
(45) Date of Patent: Oct. 6, 2026

(54) VARIABLE RESISTANCE DEVICE

(71) Applicant: THE CURATORS OF THE UNIVERSITY OF MISSOURI, Columbia, MO (US)

(72) Inventors: Ashok Midha, Rolla, MO (US); Vamsi Lodagala, Rolla, MO (US); Pratheek Bagivalu Prasanna, Rolla, MO (US); Kyle Buschkoetter, University City, MO (US); Jyothi Komatireddy, Schaumburg, IL (US); Sushrut G. Bapat, Berkeley, CA (US)

(73) Assignee: The Curators of the University of Missouri, Columbia, MO (US)

( * ) Notice: Subject to any disclaimer, the term of this patent is extended or adjusted under 35 U.S.C. 154(b) by 162 days.

(21) Appl. No.: 18/293,691

(22) PCT Filed: Aug. 10, 2022

(86) PCT No.: PCT/US2022/039982
§ 371 (c)(1),
(2) Date: Jan. 30, 2024

(87) PCT Pub. No.: WO2023/018818
PCT Pub. Date: Feb. 16, 2023

(65) Prior Publication Data

US 2024/0342534 A1 Oct. 17, 2024

Related U.S. Application Data

(60) Provisional application No. 63/232,913, filed on Aug. 13, 2021.

(51) Int. Cl.
*A63B 21/02* (2006.01)
*A63B 21/00* (2006.01)
(Continued)

(52) U.S. Cl.
CPC ..... *A63B 21/026* (2013.01); *A63B 21/0004* (2013.01); *A63B 21/05* (2013.01); *A63B 23/03508* (2013.01); *A63B 23/16* (2013.01)

(58) Field of Classification Search
CPC ..... A63B 21/0004; A63B 21/00069; A63B 21/015; A63B 21/026; A63B 21/05; A63B 23/03508; A63B 23/16
See application file for complete search history.

(56) References Cited

U.S. PATENT DOCUMENTS 3,003,764 A * 10/1961 Yovanovitch .... A63B 21/00043 482/49
3,570,849 A 3/1971 Ratchford
(Continued)

OTHER PUBLICATIONS

International Search Report and Written Opinion mailed Nov. 1, 2022 in corresponding PCT/US2022/039982, 13 pages.
(Continued)

*Primary Examiner* — Megan Anderson
(74) *Attorney, Agent, or Firm* — HOVEY WILLIAMS LLP

(57) ABSTRACT

A variable resistance device includes first and second body elements and a force-generating system disposed therebetween. The force-generating system includes a resiliently deflectable beam extending relative to the first body element and toward the second body element, an interface element, and a cam projecting relative to the second body element and toward the first body element. The cam presents a cam surface. The interface element shifts along the cam surface upon application of a driving force to at least one of the body elements relative to the other and consequent shifting of the body elements relative to each other, resulting in corresponding bending of the beam and consequent generation of a resistance force by the beam. The cam surface presents a profile that varies along a length thereof, such that the
(Continued)

resistance force generated by the beam varies irregularly as the interface element moves along the cam surface.

22 Claims, 26 Drawing Sheets

(51) Int. Cl.

| | |
|---|---|
| ***A63B 21/05*** | (2006.01) |
| ***A63B 23/035*** | (2006.01) |
| ***A63B 23/16*** | (2006.01) |

(56) References Cited

U.S. PATENT DOCUMENTS

| | | | | |
|---|---|---|---|---|
| 5,649,454 | A | 7/1997 | Midha et al. | |
| 7,060,012 | B2 | 6/2006 | Howell et al. | |
| 7,077,787 | B1 | 7/2006 | Wiesman | |
| 7,967,732 | B2 | 6/2011 | D Addario et al. | |
| 8,133,158 | B2 * | 3/2012 | An | A63B 23/16 482/44 |
| 11,052,283 | B2 * | 7/2021 | An | A63B 23/16 |
| 2008/0300112 | A1 | 12/2008 | Crout | |
| 2010/0255956 | A1 | 10/2010 | An | |
| 2015/0031507 | A1 | 1/2015 | Vedeloff et al. | |
| 2020/0368577 | A1 | 11/2020 | An | |
| 2021/0086029 | A1 | 3/2021 | Daniel | |

OTHER PUBLICATIONS

International Preliminary Report on Patentability mailed Feb. 22, 2024 in corresponding PCT/US2022/039982, 8 pages.

Buschkoetter et al., "Design of a Compliant Mechanism to Generate an Arbitrary Nonlinear Force-Deflection Profile," Proceedings of the ASME 2018 International Design Engineering Technical Conferences and Computers and Information in Engineering Conference, IDETC/CIE 2018, Aug. 26-29, 2018, Quebec City, Quebec, Canada, 9 pages.

Komatireddy et al., "A Methodology to Design a Variable Resistance Hand Exerciser Using a Compliant Mechanism," Proceedings of the ASME 2020 International Design Engineering Technical Conferences and Computers and Information in Engineering Conference, IDETC/CIE2020, Aug. 16-19, 2020, St. Louis, MO, USA, 14 pages.

Howell, Larry L., Ph.D., "A generalized loop-closure theory for the analysis and synthesis of compliant mechanisms," Purdue University Graduate School Thesis Acceptance, Dec. 1993, 239 pages.

Howell et al., "Dimensional Synthesis of Compliant Constant-Force Slider Mechanisms," Machine Elements and Machine Dynamics, DE—vol. 71, ASME, 1994, 509-515, 7 pages.

Karthik, Krutika, "On the design of a nearly constant-force modular device based on a compliant slider mechanism," Missouri University of Science and Technology Master of Science in Mechanical Engineering Thesis, 2015, 165 pages.

Christian, Andrew, "On the dynamic analysis of compliant mechanisms based on the pseudo-rigid-body model," Missouri University of Science and Technology Master of Science in Mechanical Engineering Thesis, 2015, 144 pages.

Alpha Sport, 2018 "Rainbow Putty 85g," from https://www.alphasport.com.au/product/rainbow-putty-85g, downloaded May 4, 2025, 2 pages.

Performance Health 2011, "TheraBand Hand Exerciser, Black, Extra Firm," from https://www.performhealth.com.au/Product/info/PER-26060, no download attached.

Fabrication Enterprises Inc., 2018, "CanDo Digi-Flex Hand Exercisers," from https://www.fab-ent.com/exercise/hand-flexion/cando-digi-flex-hand-exercisers, downloaded May 4, 2025, 2 pages.

Fabrication Enterprises Inc., 2018, "Fixed Hand Grip Exercisers," from https://www.fab-ent.com/exercise/hand-flexion/fixed-hand-grip-exercisers, downloaded May 4, 2025, 2 pages.

Health Products For You 2018, "Norco Hand Exerciser," from https://www.healthproductsforyou.com/p-hand-exerciser.html, downloaded May 4, 2025, 8 pages.

Jutte et al., "Design of Single, Multiple, and Scaled Nonlinear Springs for Prescribed Nonlinear Responses," Journal of Mechanical Design, Trans. ASME, vol. 132, No. 1, (2010): pp. 011003-1-011003-10, 10 pages.

Jutte, Christine V. "Generalized Synthesis Methodology of Nonlinear Springs for Prescribed Load-Displacement Functions," Ph.D. Dissertation, Mechanical Engineering, The University of Michigan, Ann Arbor, MI, 2008, 163 pages.

"Hand Strengthening Exerciser Equipment," 2020, https://www.rehab-store.com/c-hand-exercisers.html, no download attached.

Flint Rehab, "Hand Therapy Putty Exercises," from https://www.flintrehab.com/2016/hand-therapy-puttyexercises, downloaded May 4, 2025, 11 pages.

"Patterson Medical Supply Replacement Hand Exerciser Bands Ultimate Hand Helper," last modified on Sep. 22, 2019, accessed Feb. 1, 2020. https://www.devineexpress.com/products/925305-patterson-medical-supplyreplacement-hand-exerciser-bands-ultimate-handhelper?variant=15652903780395&cmp_id=403238383&adg_id=1345802770256.

Healio Health, "Arthritis Pain Reliever, Hand Strengthening Xtensor Pain Relief Device," http://healiohealth.com/products/index/5032, downloaded May 4, 2025, 2 pages.

"Fitmotion Hand Exerciser Band," 2020, http://www.juskeepsmile.net/2017/09/fitmotion-hand-exerciseband-latex-free.html, no download attached.

"Cando Digi-Flex Finger Exerciser & Hand Exerciser," last modified on Jan. 5, 2021, accessed Feb. 12, 2020. https://www.allegromedical.com/gift-ideas-c573/digi-flex-exercise-rehabilitationsystemp191759.html?CS_003=9164468&CS_010=8ab281020bb66dff010bb67e1ffe5383&msclkid=7cbd7911458d1bfef8e326b58795f0a6&utm_source=bing&utm_medi.

"5 Best Arthritis Gloves on The Market," https://www.healthline.com/health/best-arthritisgloves#imak-arthritis-gloves, downloaded May 4, 2025, 14 pages.

"Finger strength helper," last modified on Aug. 20, 2020, accessed Mar. 8, 2020. https://www.amazon.com/Sammons-Preston-Rehabilitation-Strengthening-Resistance/dp/B071VC7LF3/ref=sr_1_6?crid=2C6QG47XTHCS&dchild=1&keywords=thumb+exerciser&sprefix=thumb+exerc%2Caps%2C177&sr=8-6, no download attached.

Midha et al., "A Primal Treatise of Constant-Force, Compliant Segments, and Mechanisms." Proceedings of the ASME 2020 International Design Engineering Technical Conferences and Computers and Information in Engineering Conference. vol. 10: 44th Mechanisms and Robotics Conference (MR). Virtual, Online. Aug. 17-19, 2020. V010T10A016. ASME. https://doi.org/10.1115/DETC2020-22761, Abstract attached, 6 pages.

* cited by examiner

VARIABLE RESISTANCE DEVICE

CROSS-REFERENCE TO RELATED APPLICATION

1. Priority Application

The present application claims priority to PCT International Patent Application No. PCT/US2022/039982, filed Aug. 10, 2022, which claims priority from U.S. Provisional Patent Application No. 63/232,913, filed Aug. 13, 2021, and entitled VARIABLE RESISTANCE DEVICE, the entire disclosure of each of which is hereby incorporated by reference herein.

BACKGROUND OF THE INVENTION

1. Field of the Invention

The present invention relates generally to a variable resistance device. Several different embodiments are disclosed herein. Certain embodiments of the present invention are respectively particularly well suited for respective use as hand exerciser devices, positioning and support structures for rotatable shafts, chuck elements, and clamp components. However, the inventive concepts might alternatively be applied in other applications in which variable resistance or energy absorption is advantageous, including but not limited to other exercise devices, doorstops, vehicle crash safety systems, prosthetics, robotics, vibration/rattle absorption devices (e.g., for shake-prone windows in high-rise buildings), and more.

Those of ordinary skill in the art will appreciate that a variety of resistance devices and materials are known in the art. For instance, hand exercises in a therapeutic setting might utilize an exercise putty of a selected stiffness or require manipulation and/or squeezing of a foam or rubber ball. More narrowly tailored devices directed to more specific exercises are also known. For instance, spring-based devices are known to provide a predetermined resistance force to individual fingers during pinching exercises or to an entire hand during a "power grip" exercise. Other exercisers make use of elastic bands such as rubber bands.

2. Discussion of the Prior Art

Whereas the malleability of putty- or ball-type exercisers facilitates use in a variety of exercises, this same flexibility limits the control one has over the exact resistances being applied.

In contrast, rubber-based exercisers of this type, including those using elastic bands, conventionally generate a logarithmic-like force-deflection curve as is characteristic of a soft spring. Conventional linear spring-based exercisers typically generate linear resistance, with the deformation of the resistance-generating element being proportional to the resistance force generated thereby. In practice, this means that the beginning of the device stroke has a lower resistance than the end of the stroke, with the resistance increasing generally logarithmically (for the rubber-based exercisers) or linearly (for the spring-based exercisers) therebetween. However, such a logarithmic or linear force profile is inconsistent with that of a typical healthy human hand, which generates a variable force profile.

Turning to prior art approaches associated with another application of the present invention, shaft centering and centering of bits and similar in chucks may be achieved through a variety of conventional means. However, such means fail to facilitate application of specific force profiles (and, in particular, variable force profiles) designed to best achieve the desired positioning without causing damage, skewing, abrupt shifts, and other disadvantageous effects.

Conventional clamps likewise fail to accommodate desired force profiles, potentially leading to application of excessive forces to a given part and consequent damage thereto.

SUMMARY

According to one aspect of the present invention, a variable resistance device is configured to generate a variable resistance force. The variable resistance device comprises a first body element, a second body element, and a force-generating system disposed between the first and second body elements. The force-generating system includes a resiliently deflectable beam, an interface element, and a cam. The beam extends relative to the first body element and toward the second body element. The beam presents a distal region spaced from the first body element. The interface element is disposed at the distal region of the beam. The cam projects relative to the second body element and toward the first body element. The cam presents a cam surface. The interface element is configured to shift along the cam surface upon application of a driving force to at least one of the body elements relative to the other of the body elements and consequent shifting of the body elements relative to each other. Shifting of the interface element along the cam surface results in corresponding bending of the beam and consequent generation of a resistance force by the beam. The cam surface presents a profile that varies along a length thereof, such that the resistance force generated by the beam varies irregularly as the interface element moves along the cam surface.

This summary is provided to introduce a selection of concepts in a simplified form. These concepts are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWING FIGURES

Preferred embodiments of the present invention are described in detail below with reference to the attached drawing figures, wherein.

Figure 1:
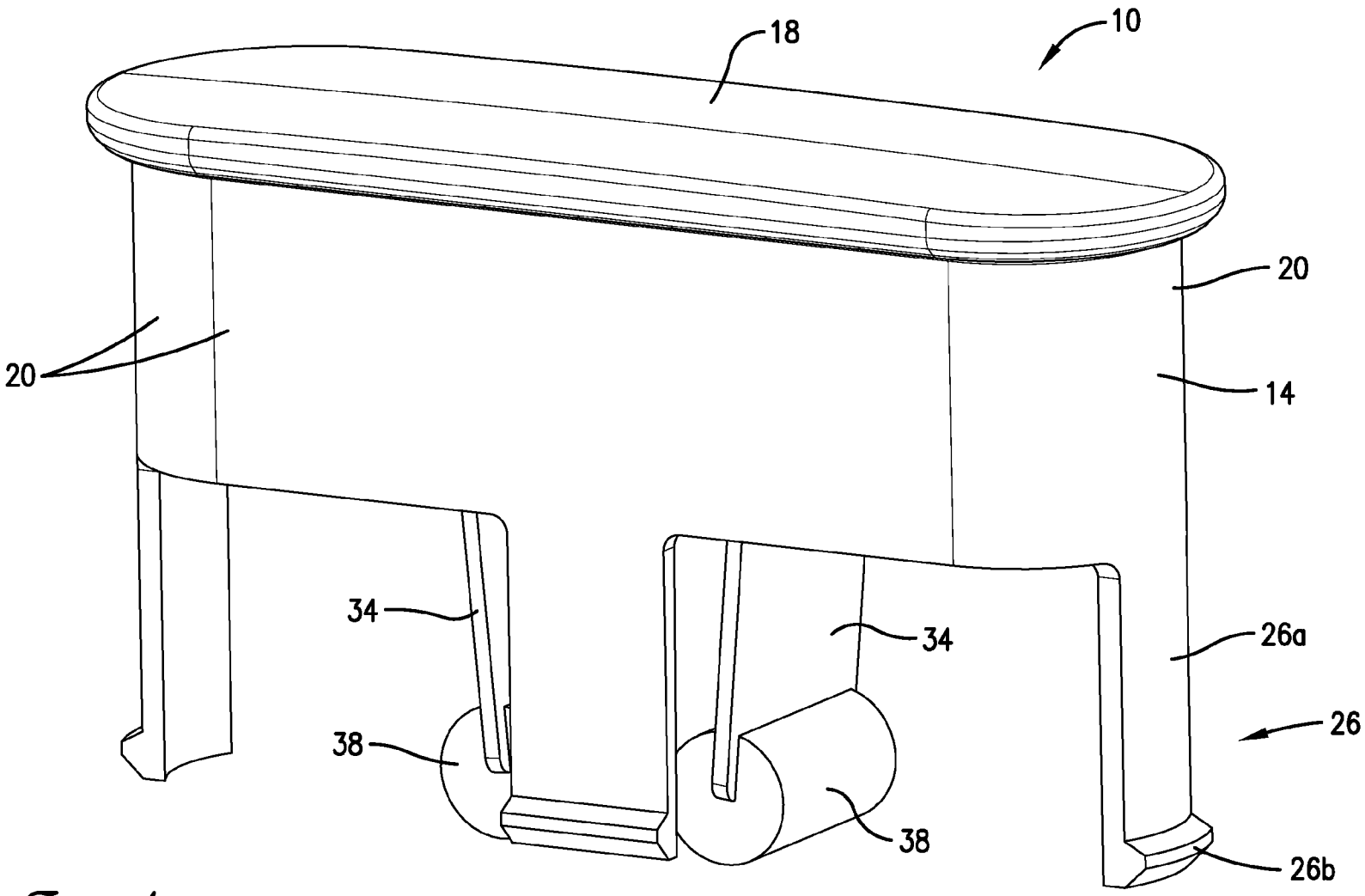
FIG. 1 is a top perspective view of an upper sliding body of a variable resistance device in accordance with a first preferred embodiment of the present invention, wherein the variable resistance device is configured for use as a hand exerciser.
Figure 2:
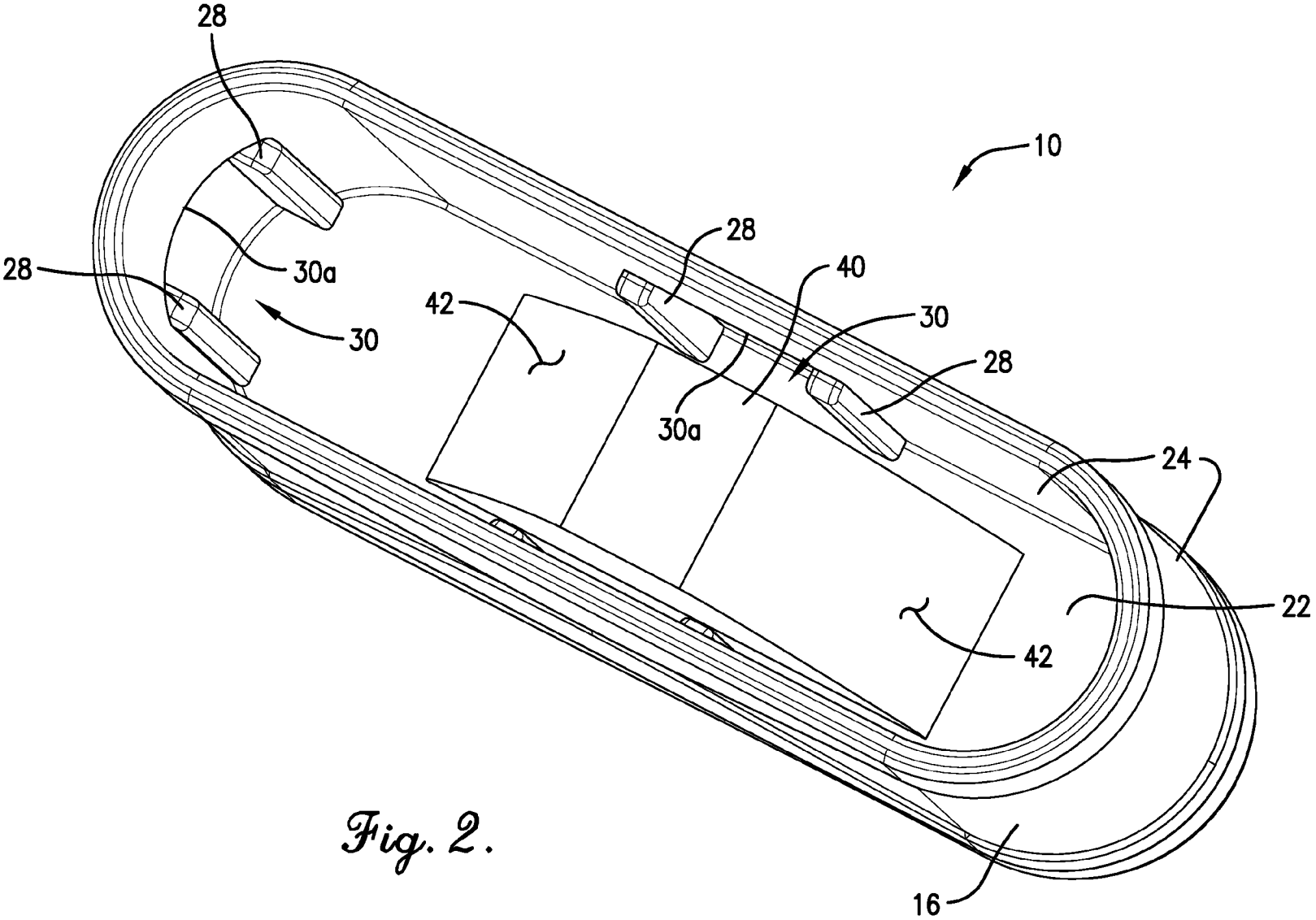
FIG. 2 is a top perspective view of a lower receiving body of the variable resistance device of FIG. 1.
Figure 3:
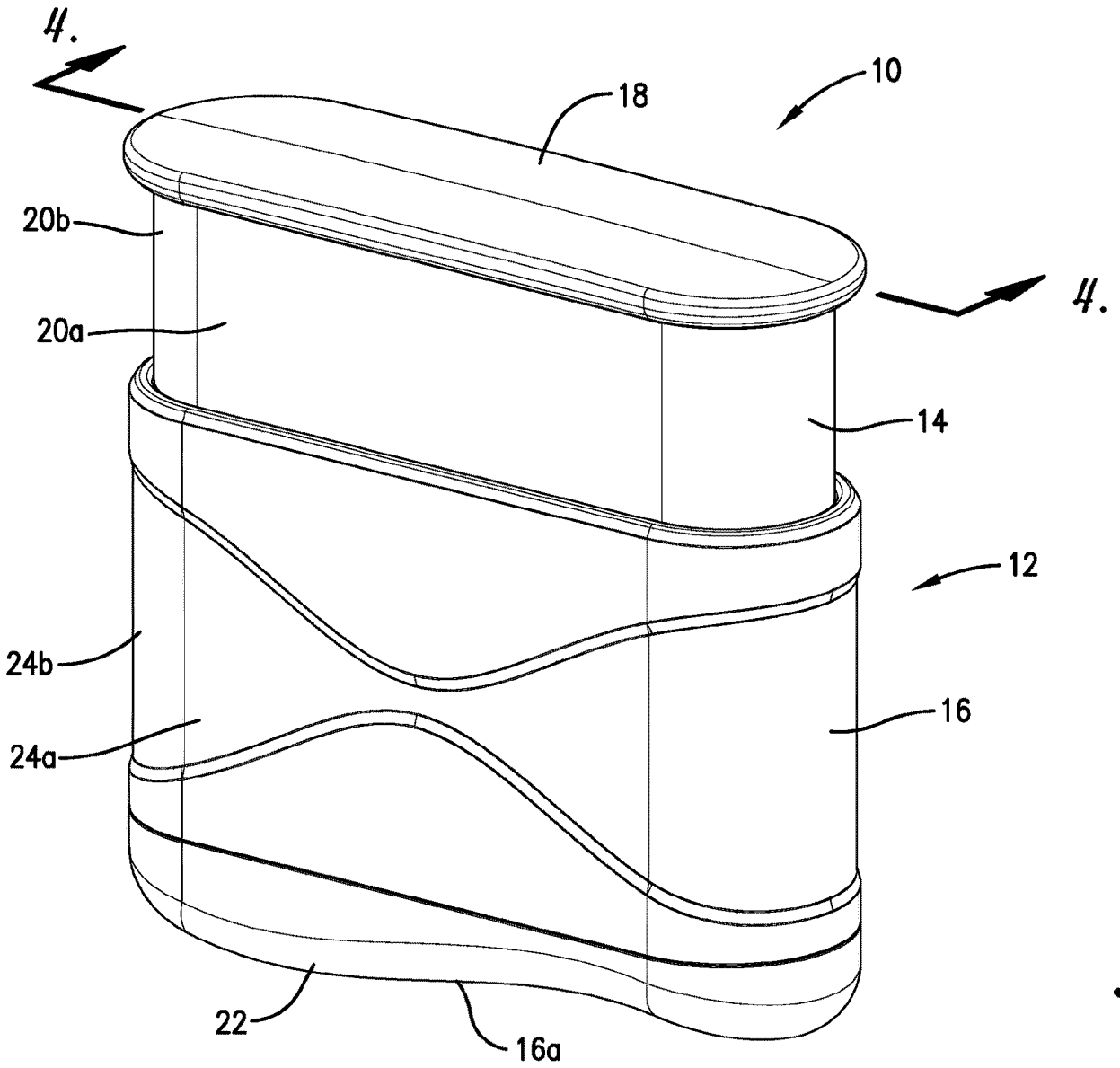
FIG. 3 is a side perspective view of the assembled variable resistance device of FIGS. 1 and 2.
Figure 4:
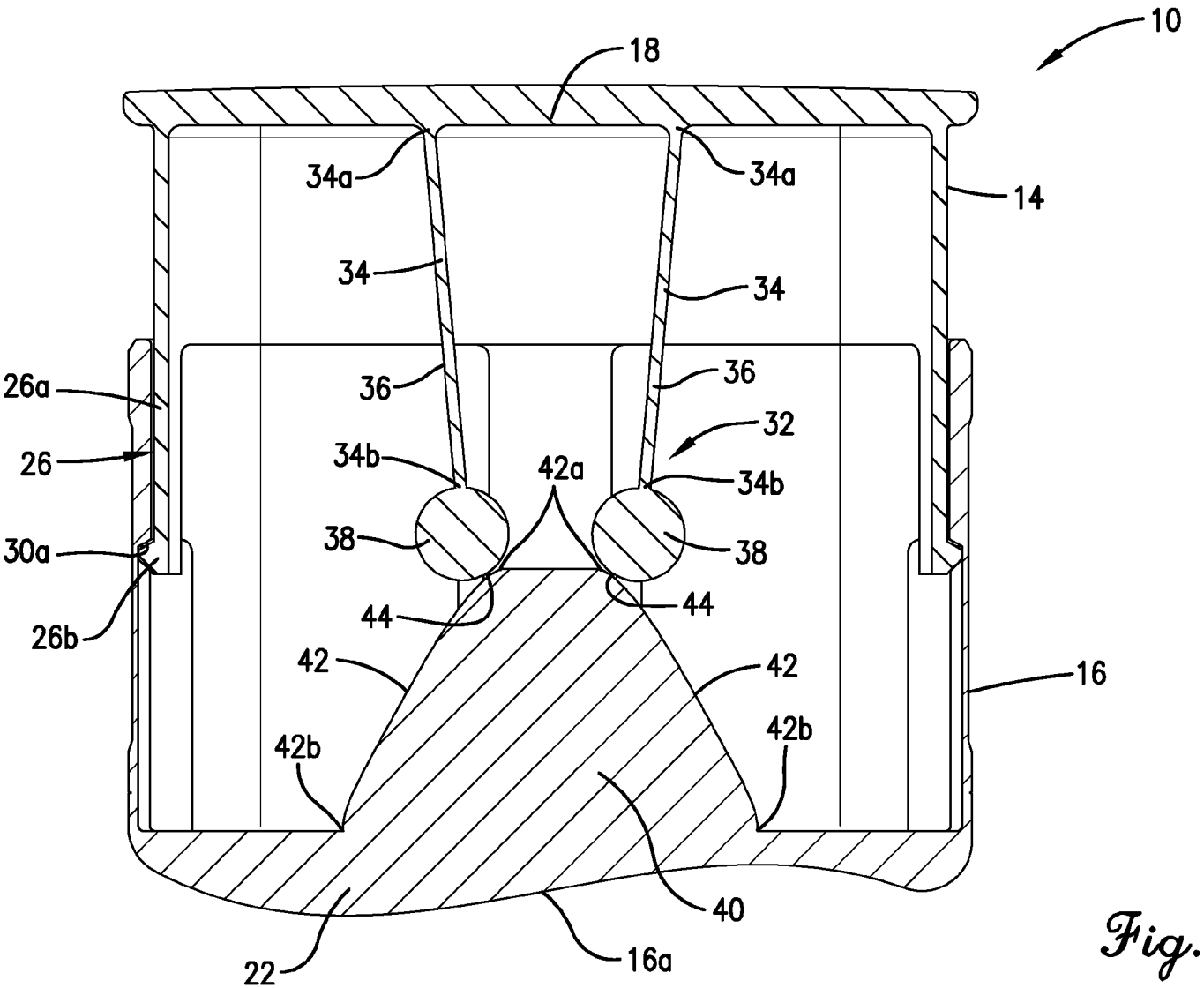
FIG. 4 is a cross-sectional front view, taken along line 4-4 of FIG. 3, of the variable resistance device of FIGS. 1-3, particularly illustrating the beams thereof in an undeflected configuration.
Figure 4A:
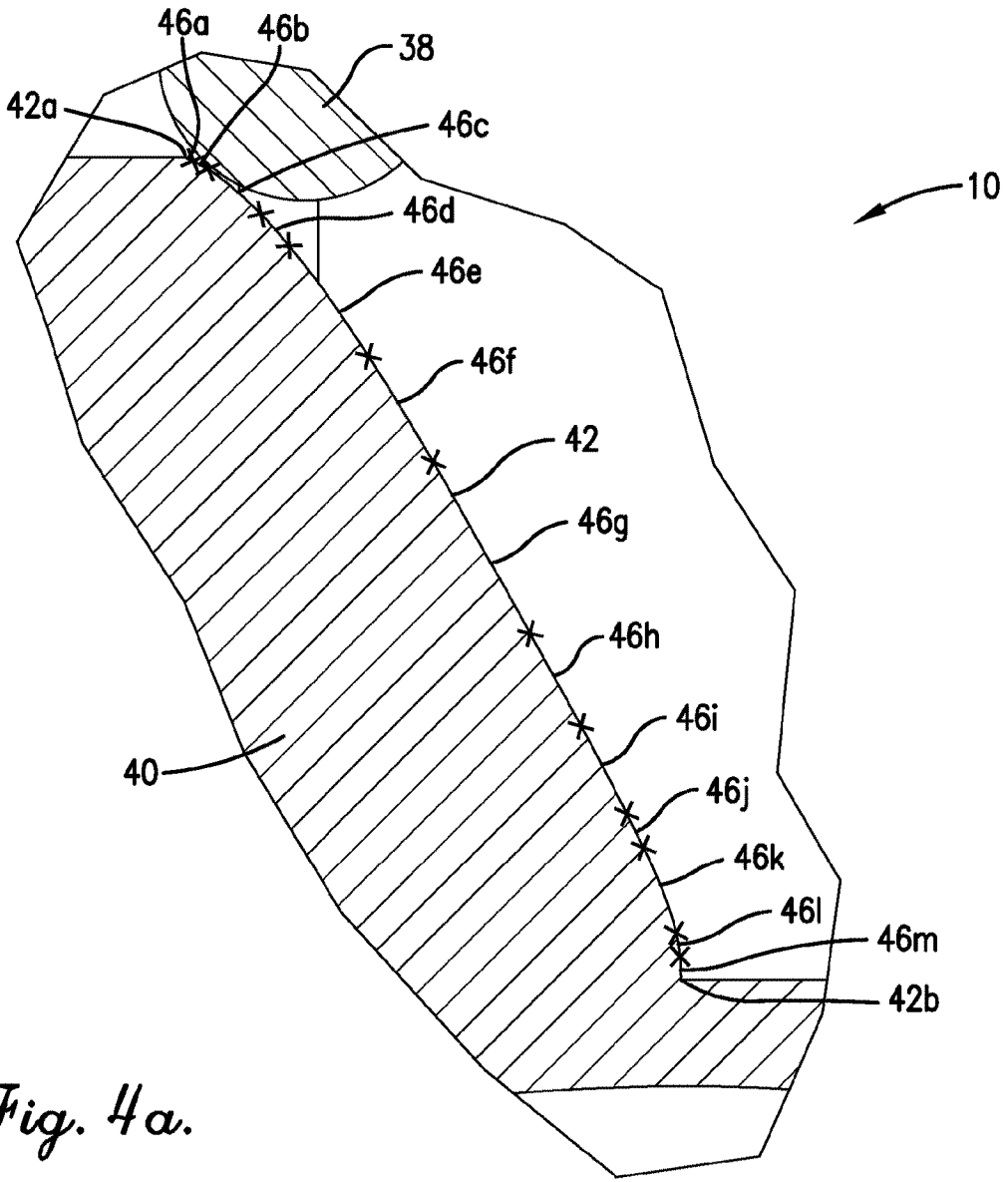
Figure 5:
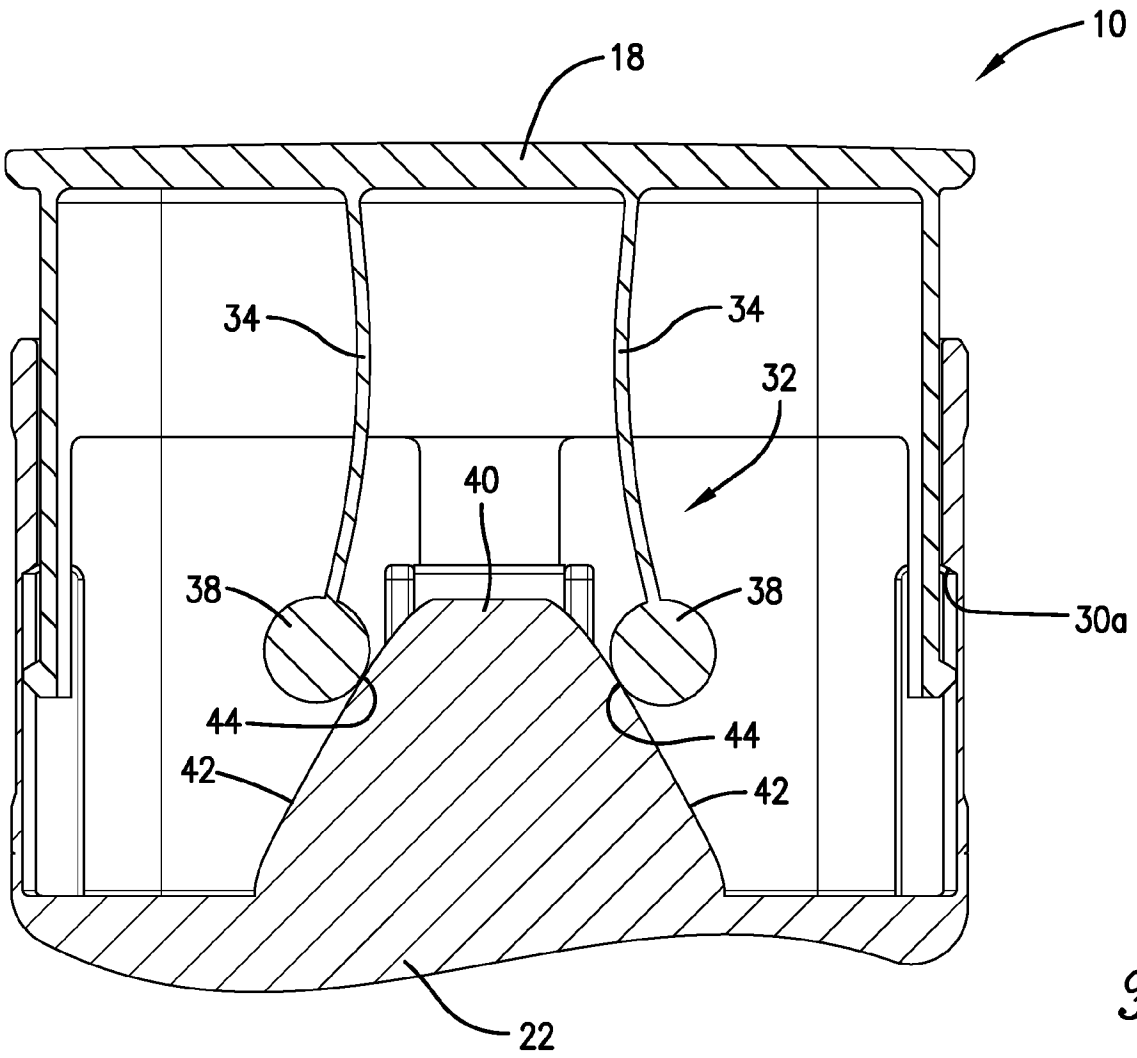
Figure 6:
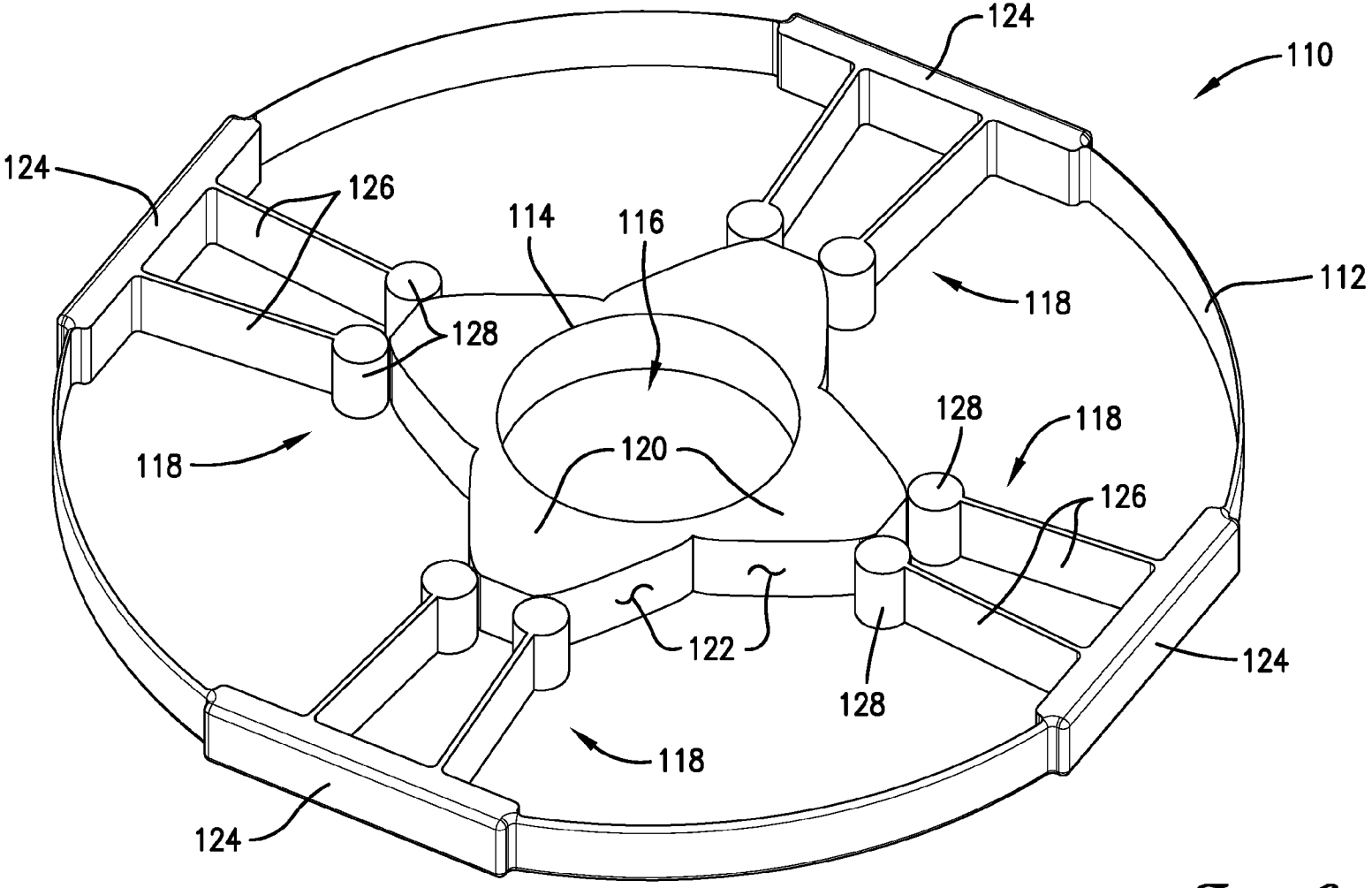
Figure 7:
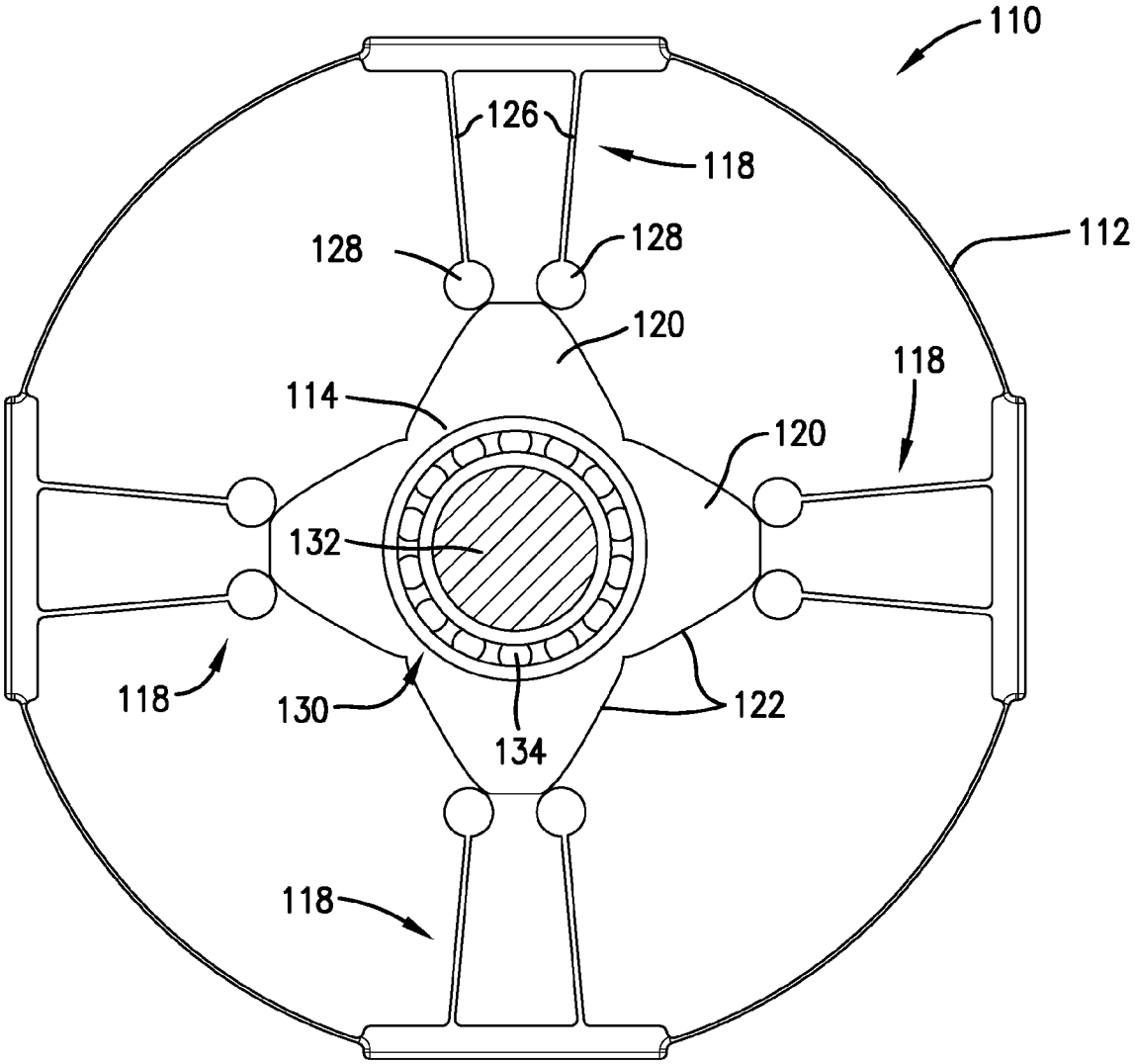
Figure 8:
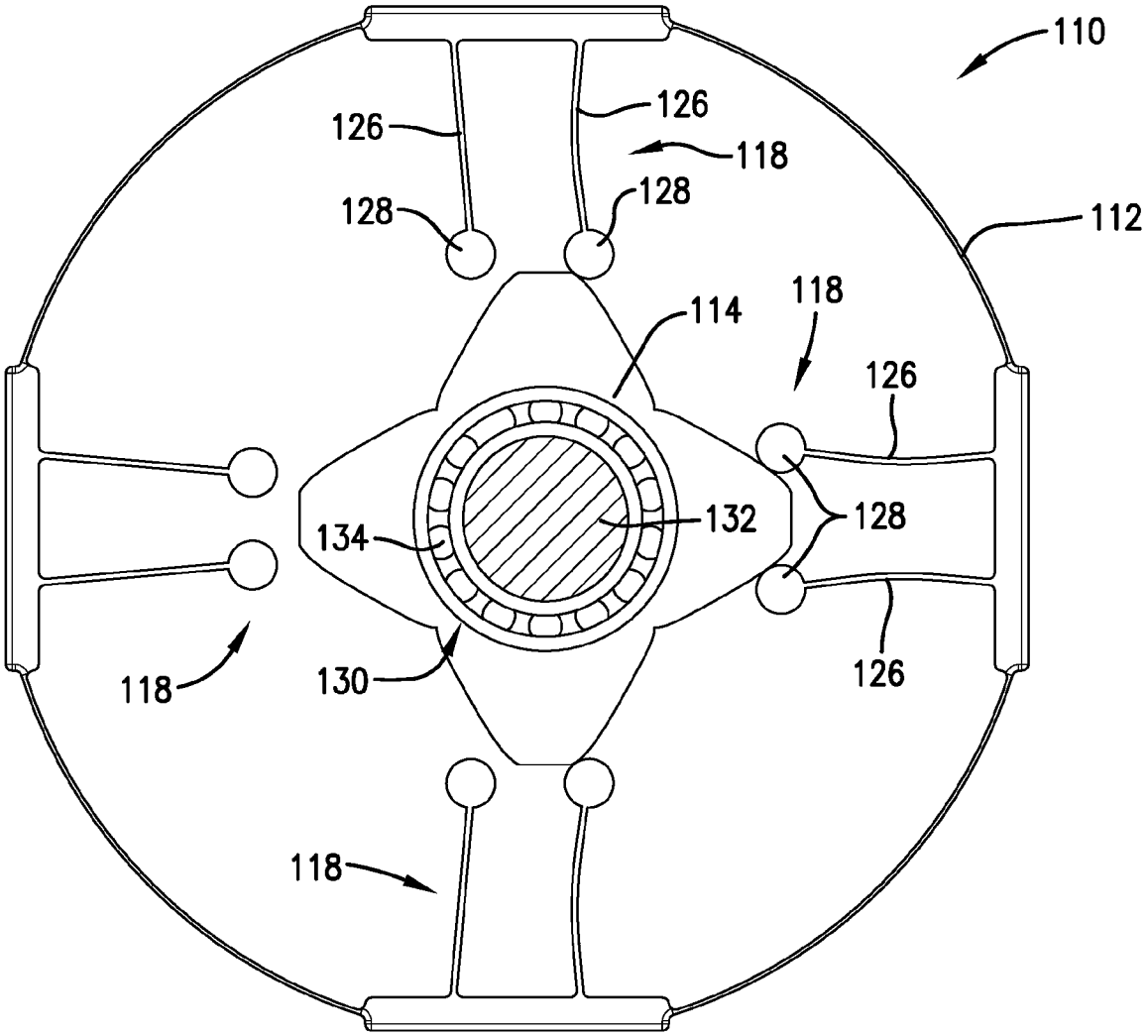
Figure 9:
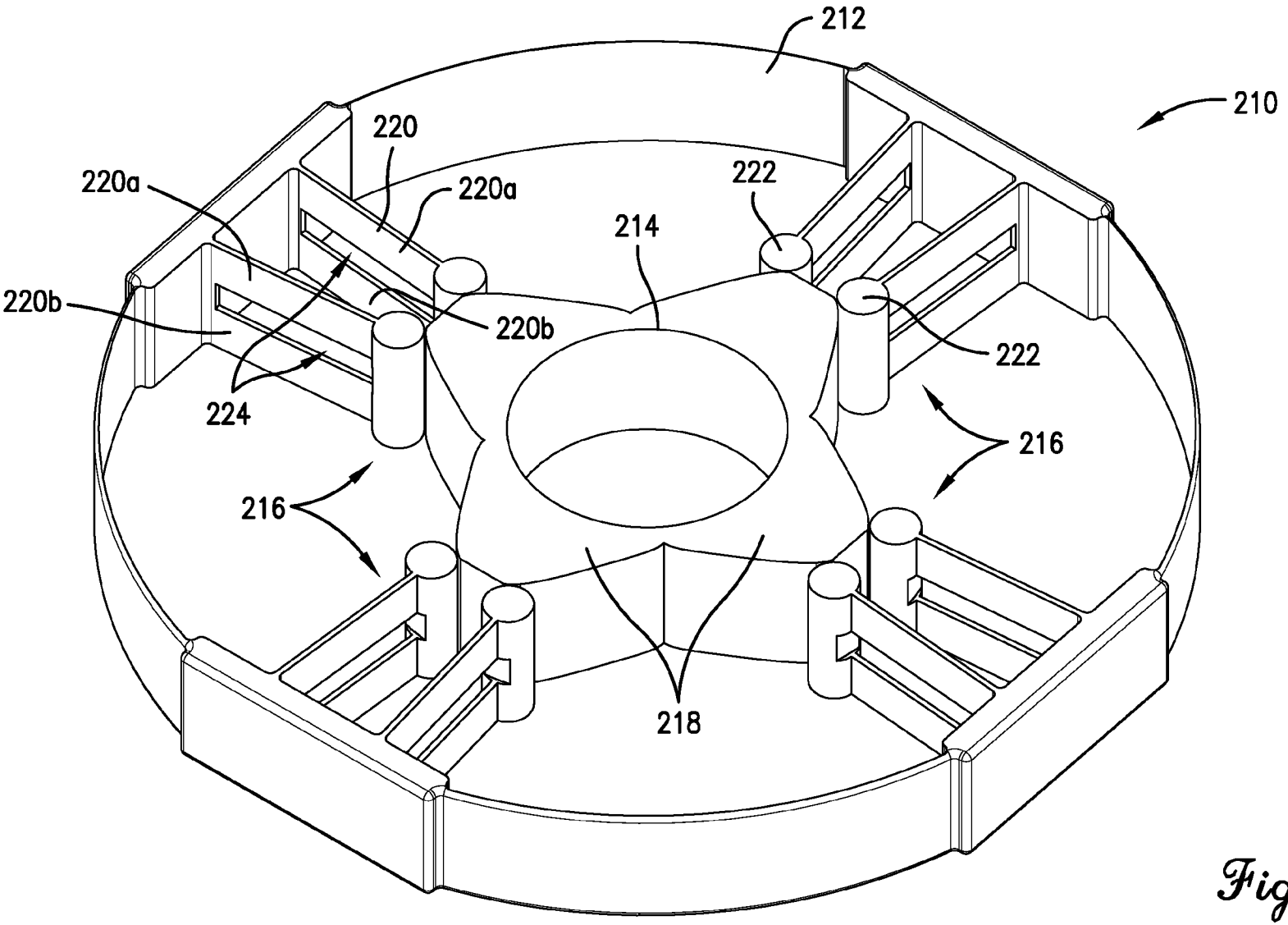
Figure 10:
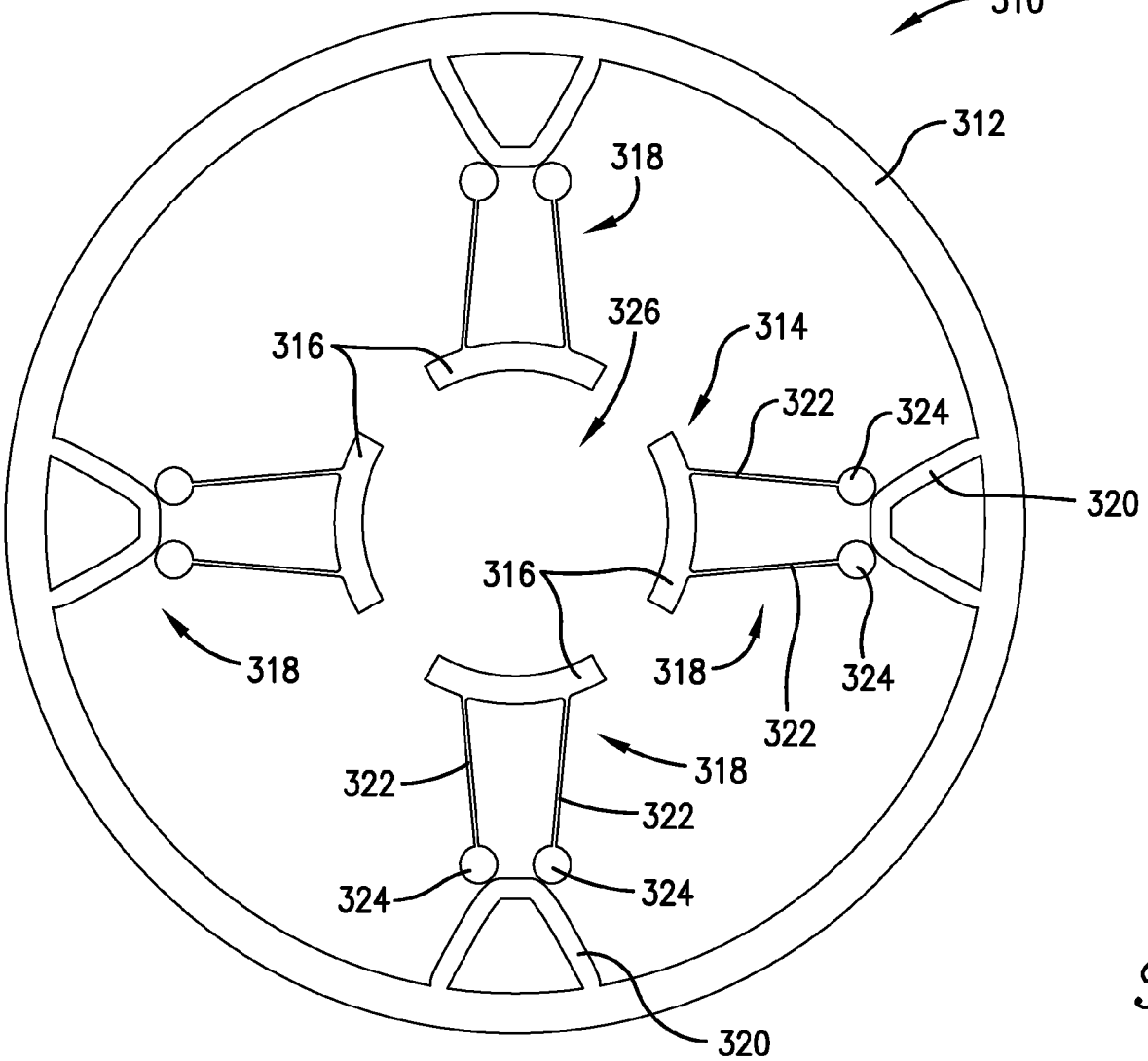
Figure 11:
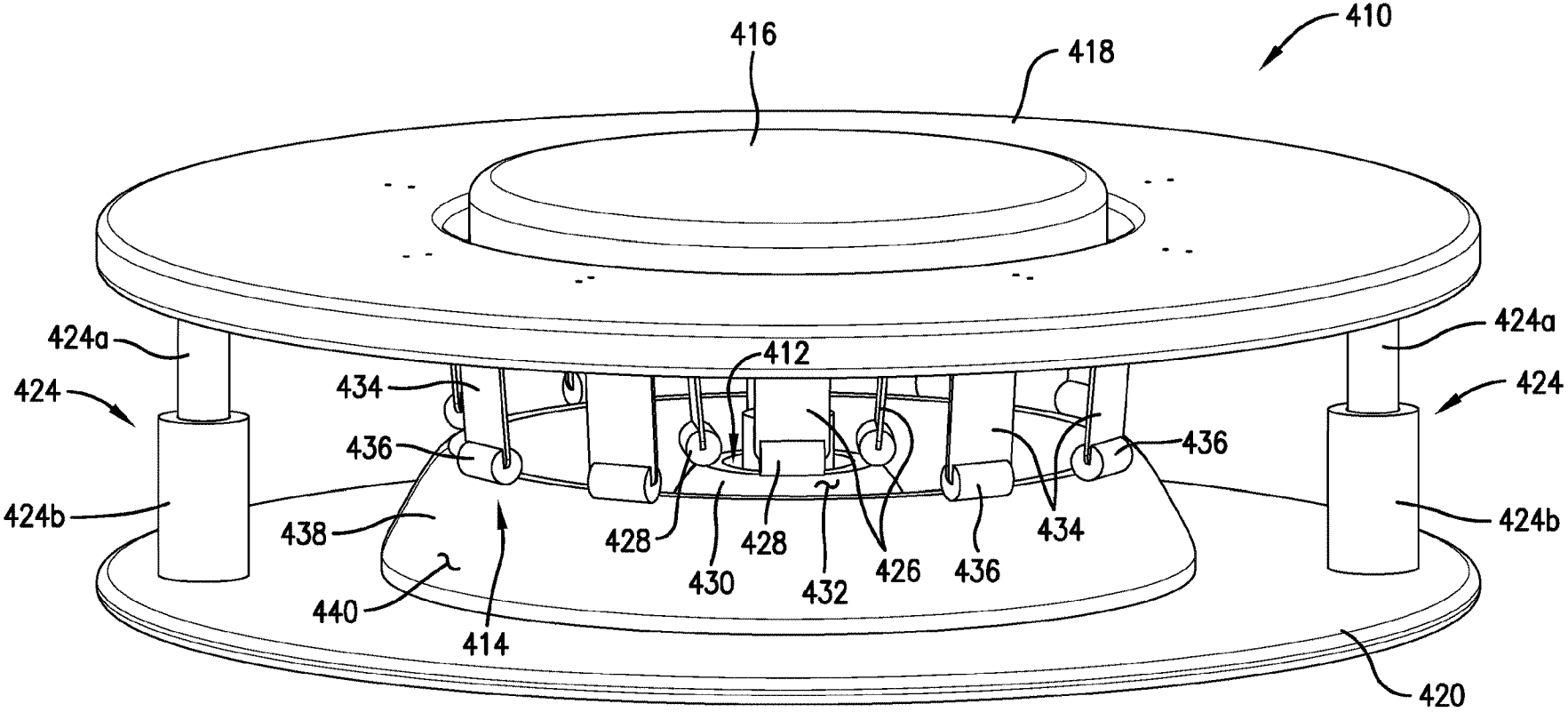
Figure 12:
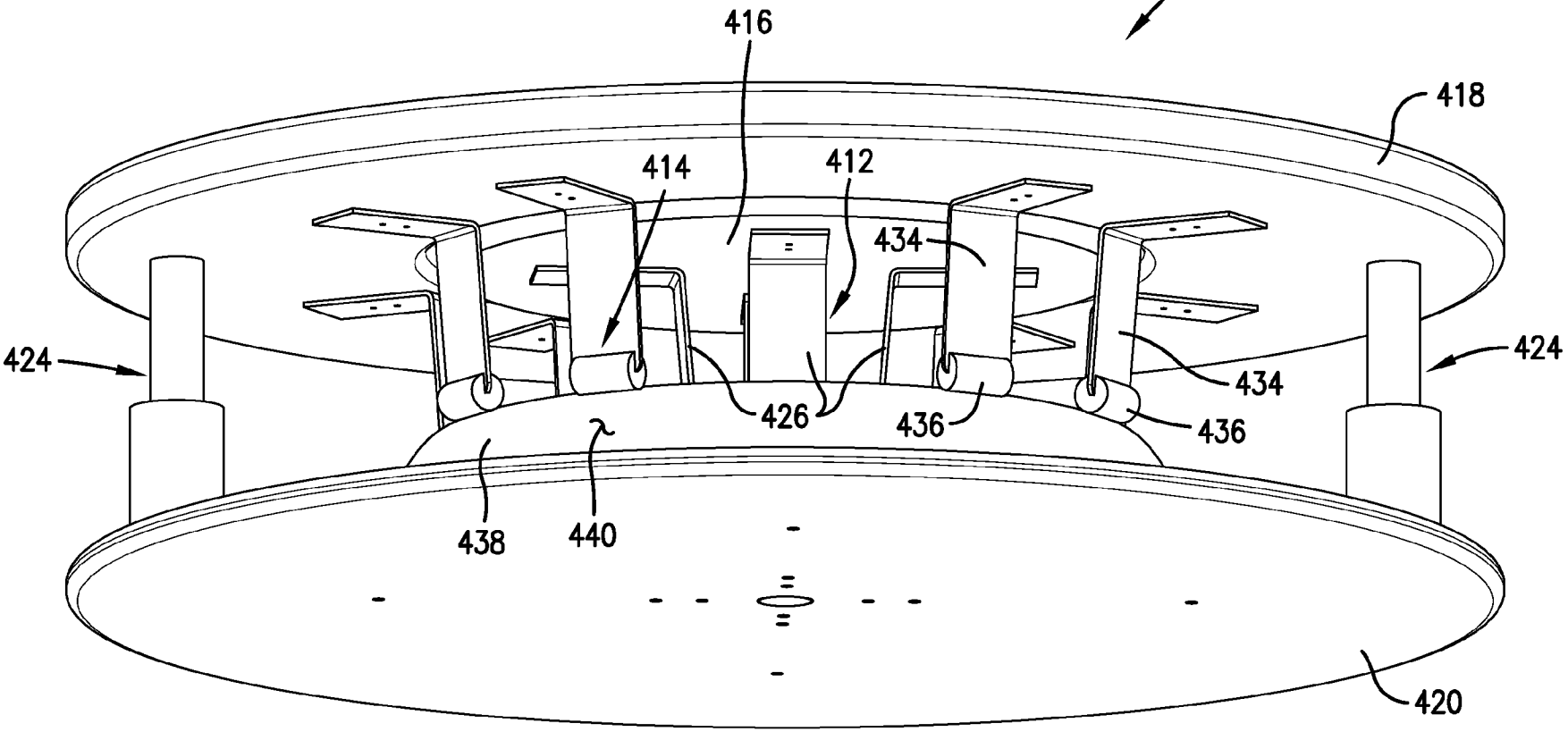
Figure 13:
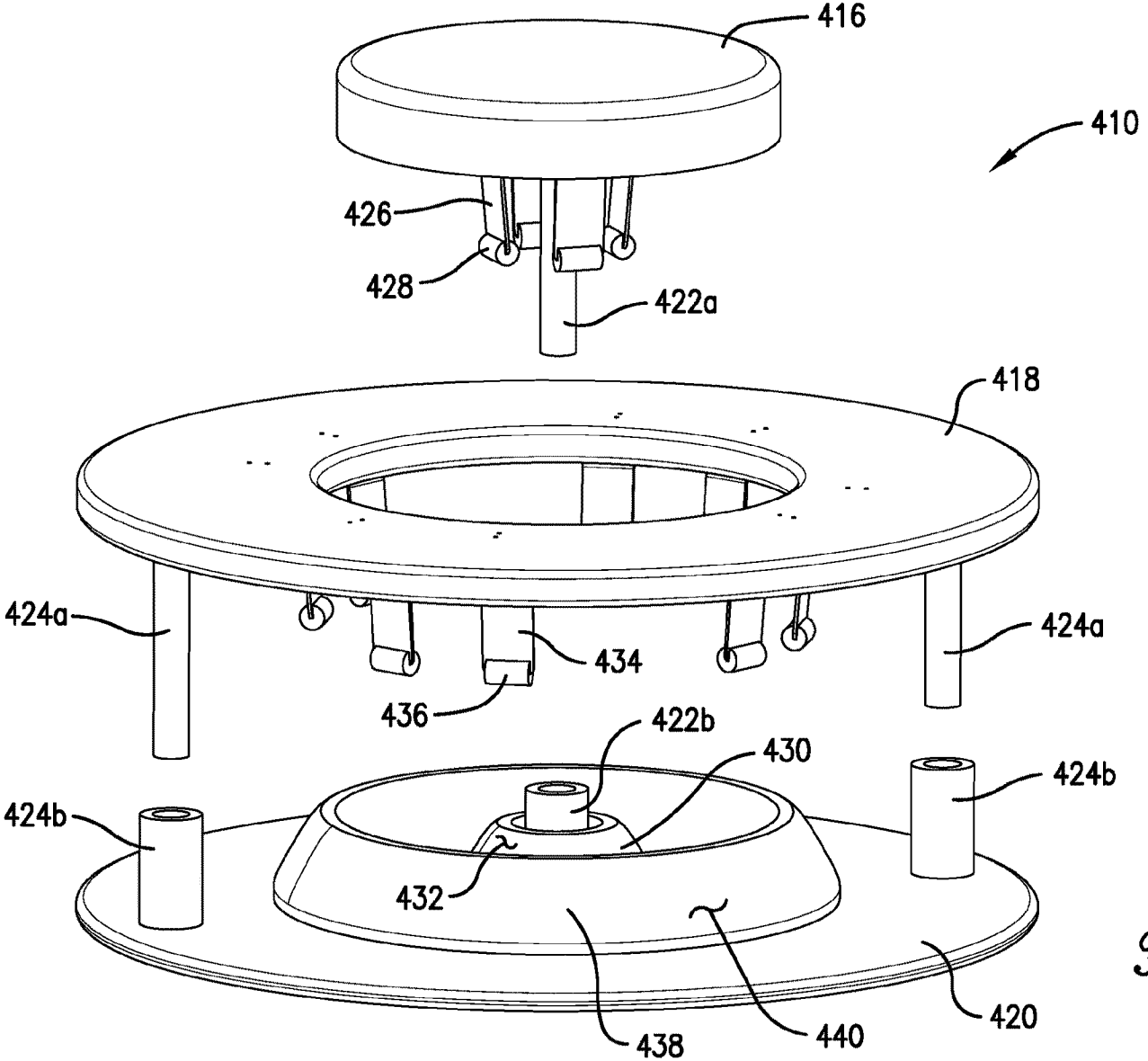
Figure 14:
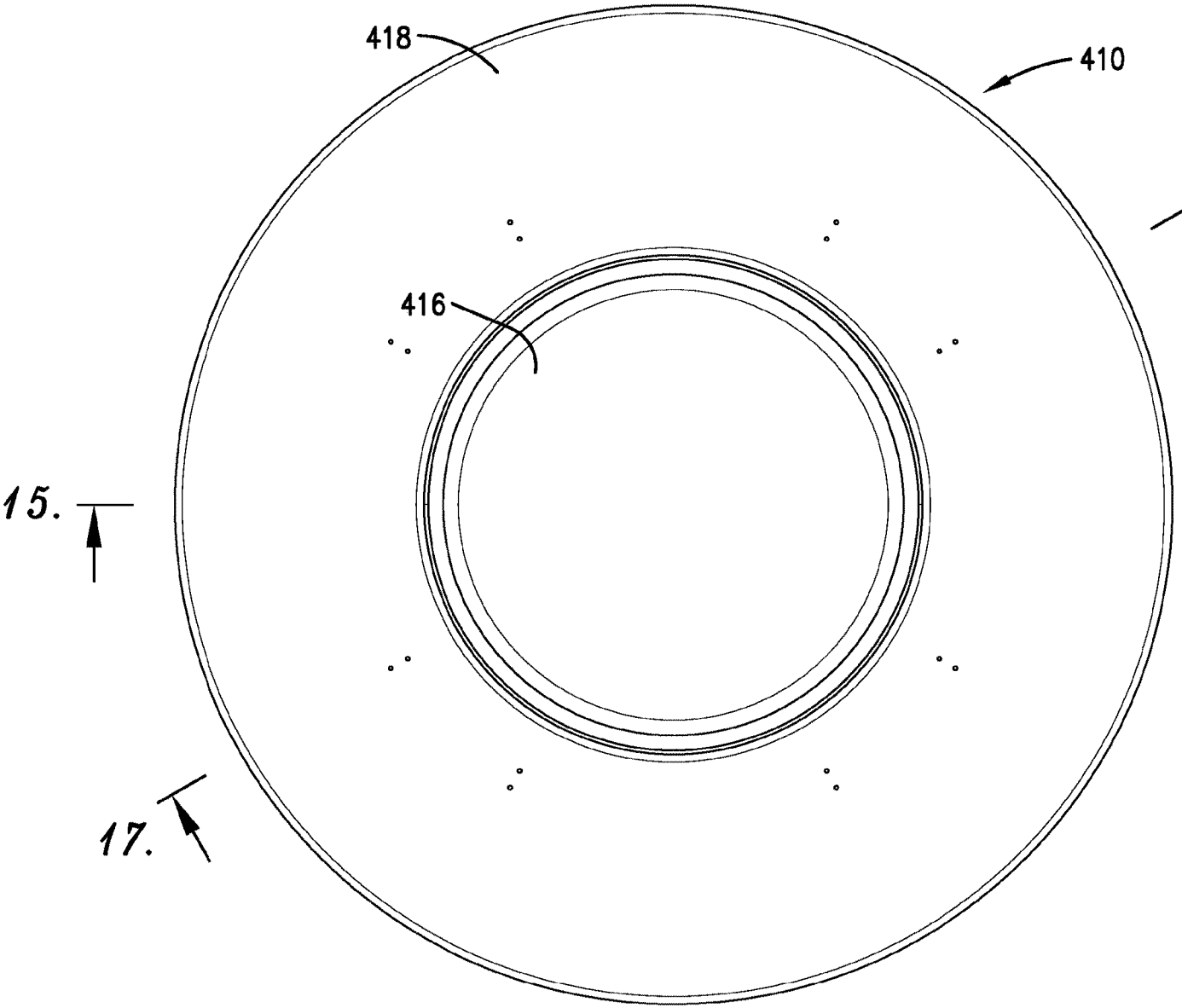
Figure 15:
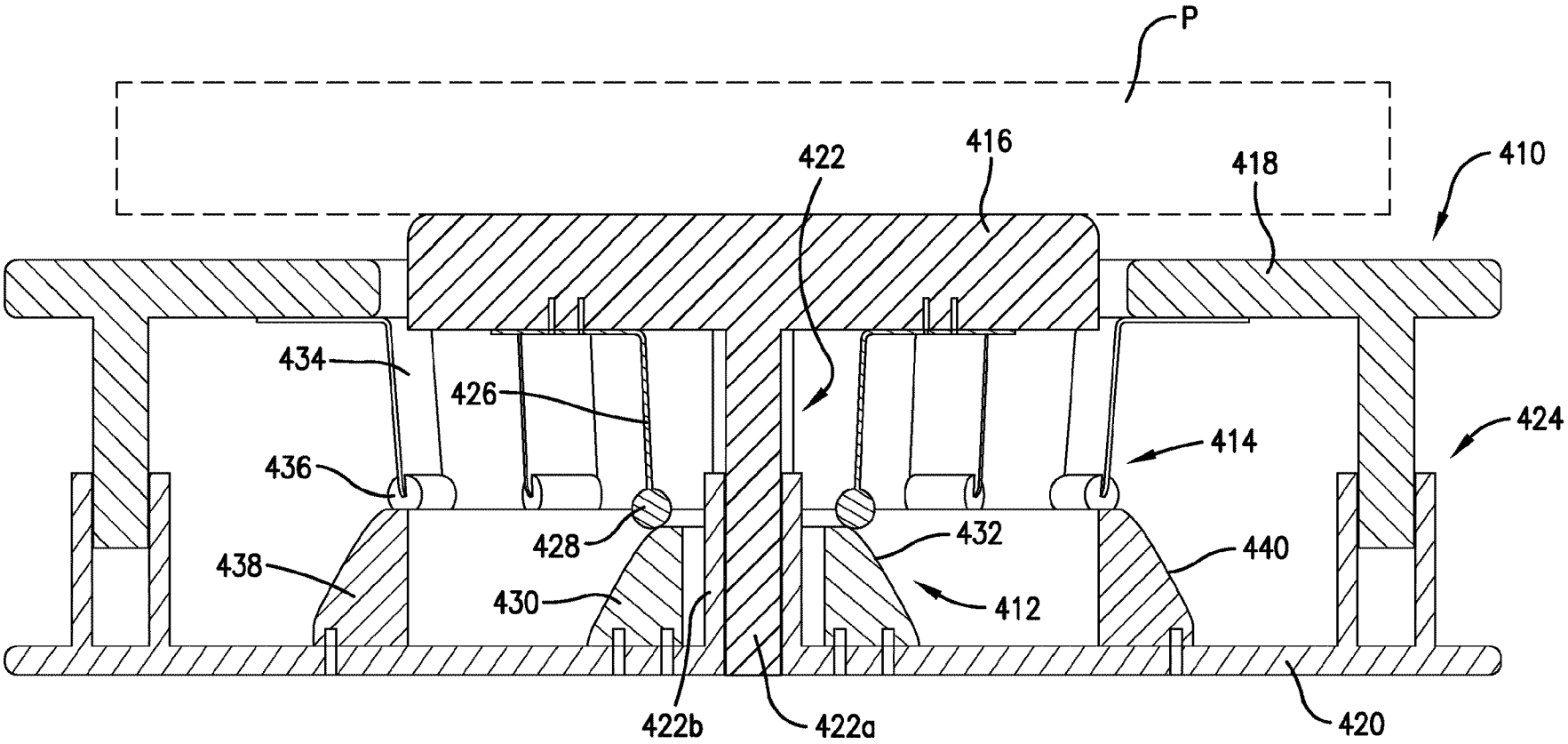
Figure 16:
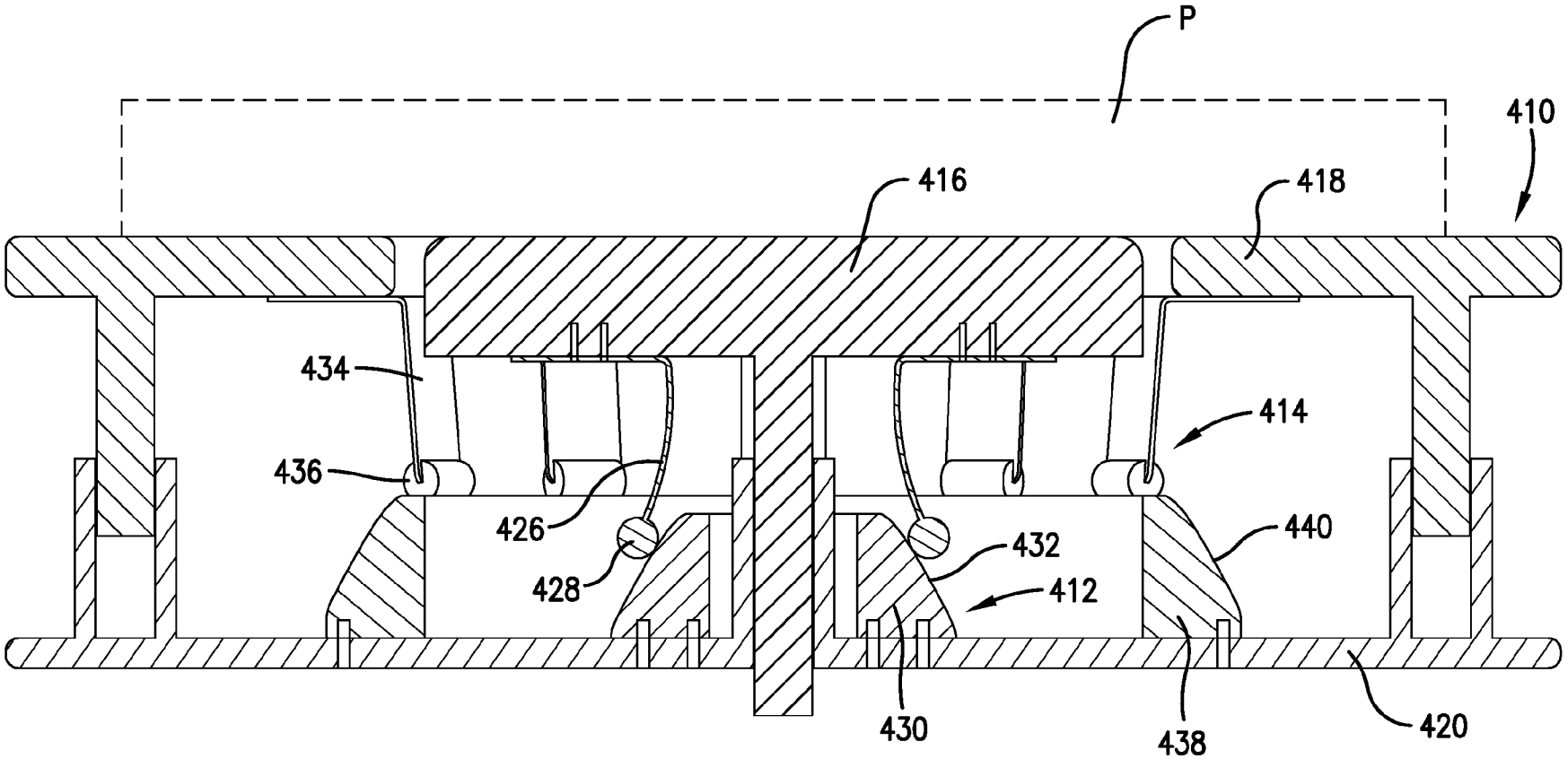
Figure 17:
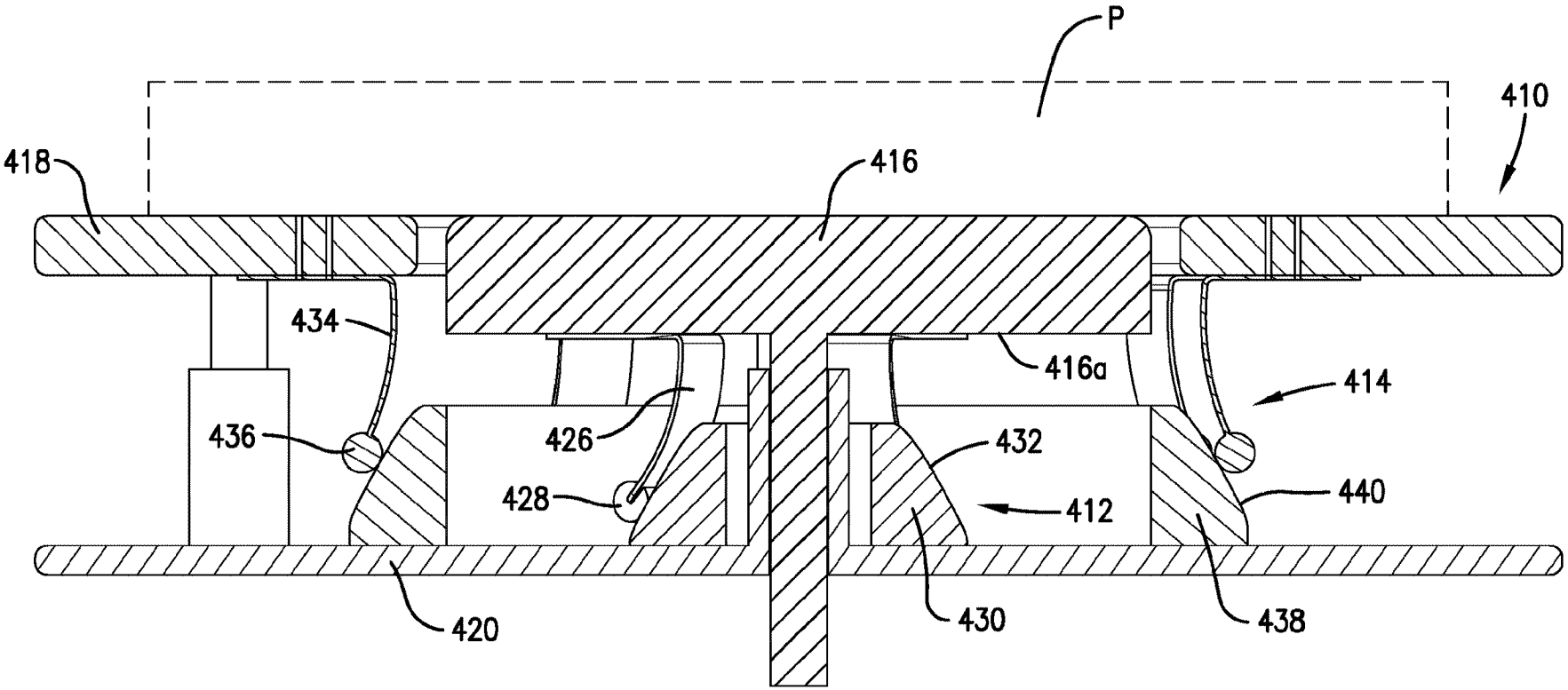
Figure 18:
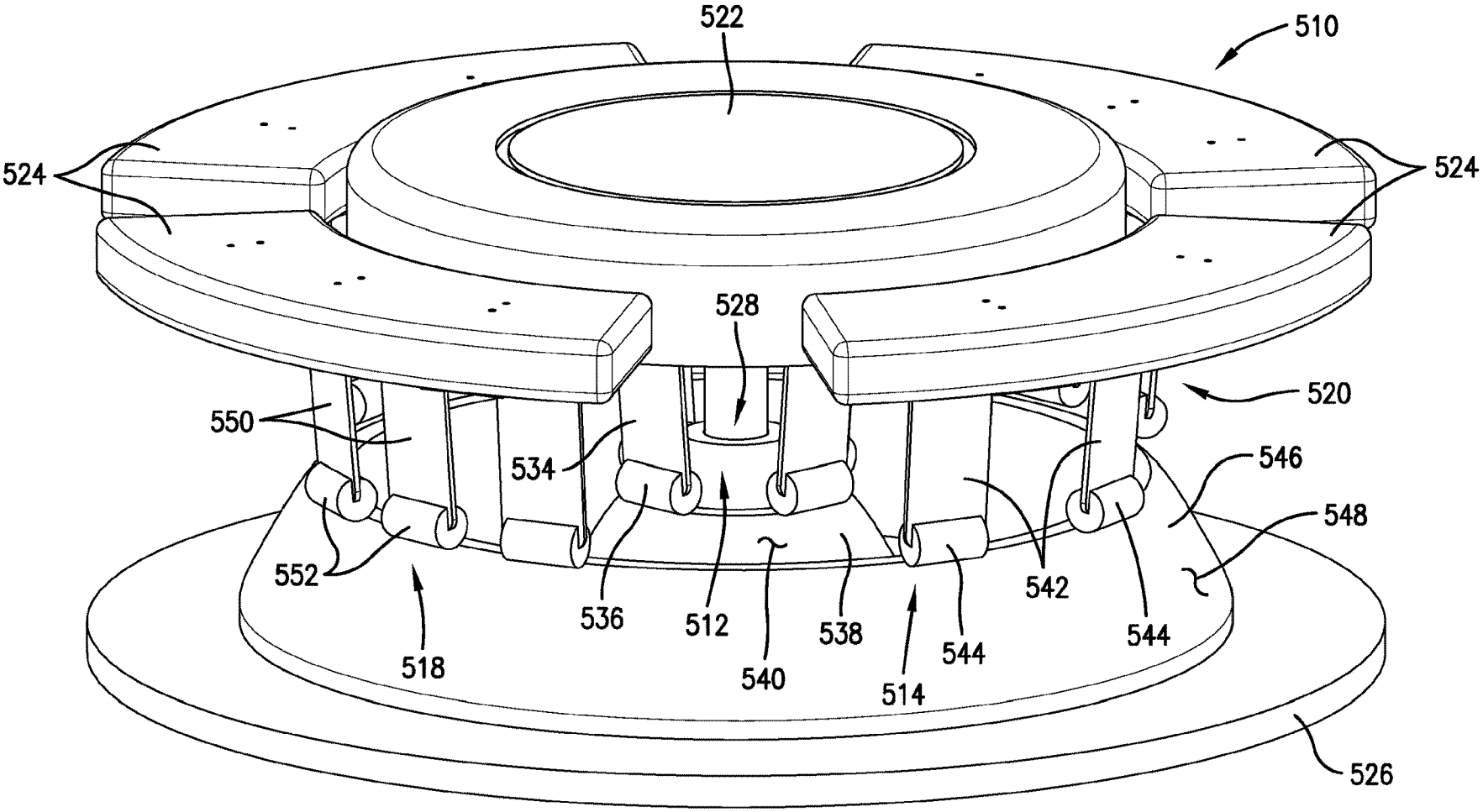
Figure 19:
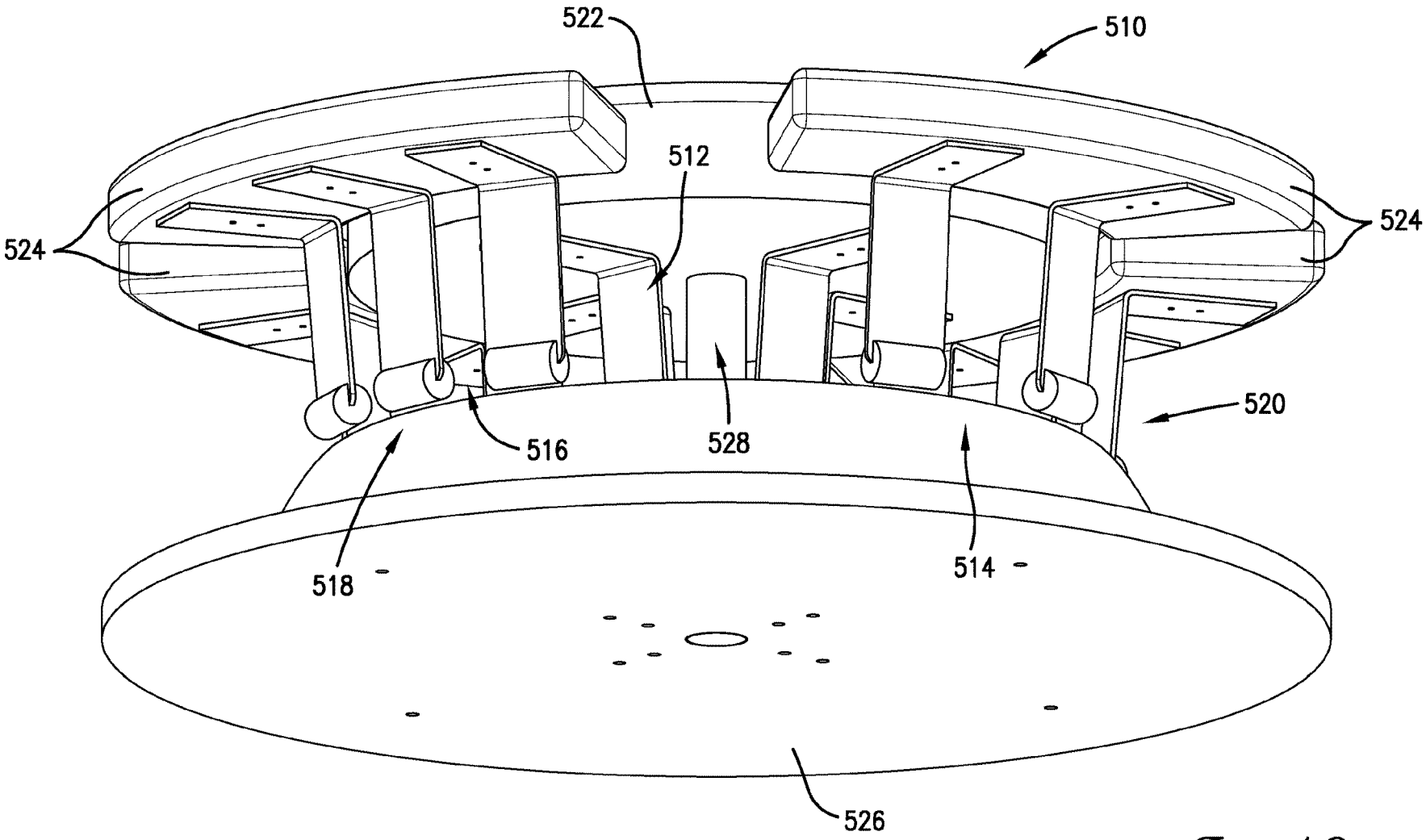
Figure 20:
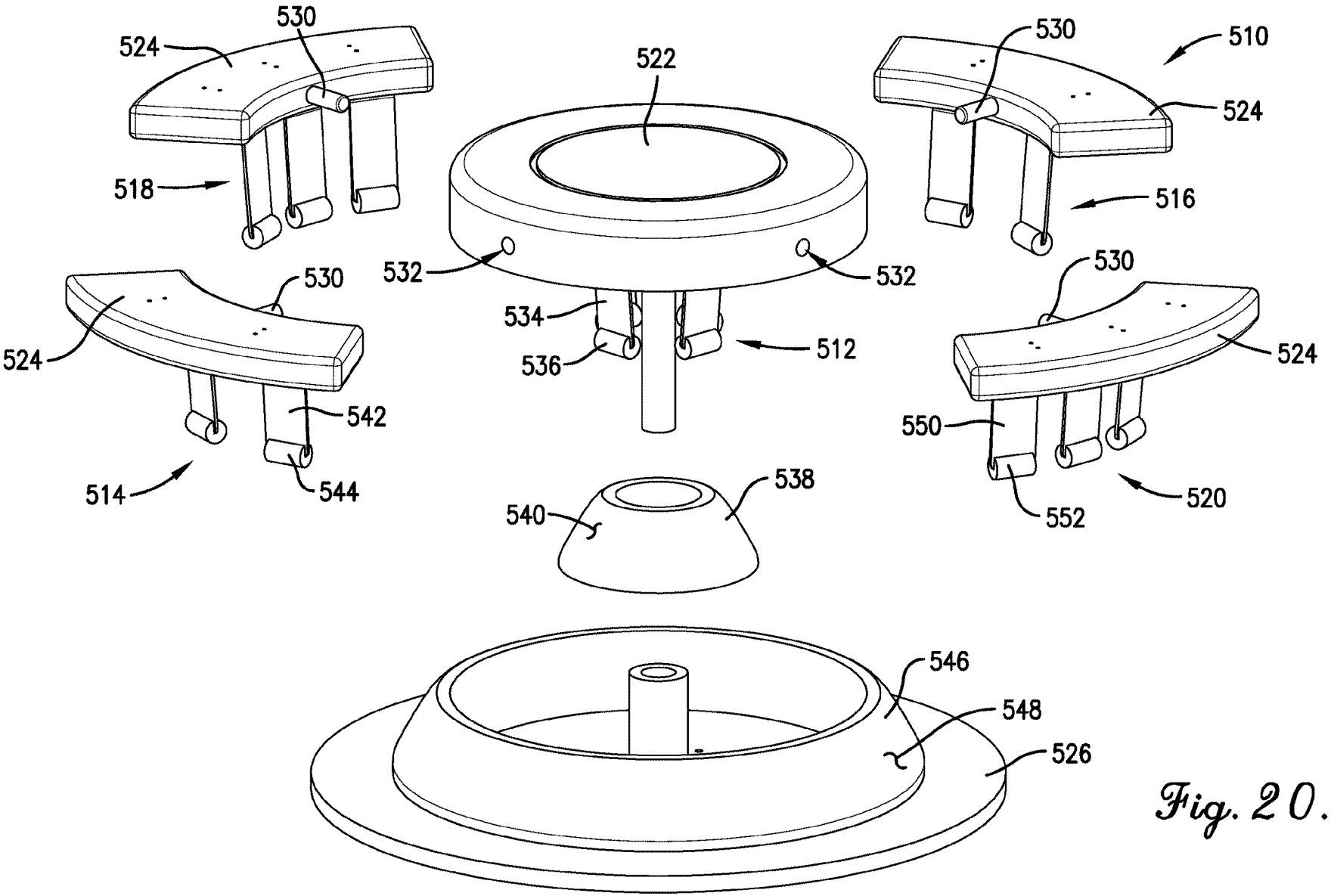
Figure 21:
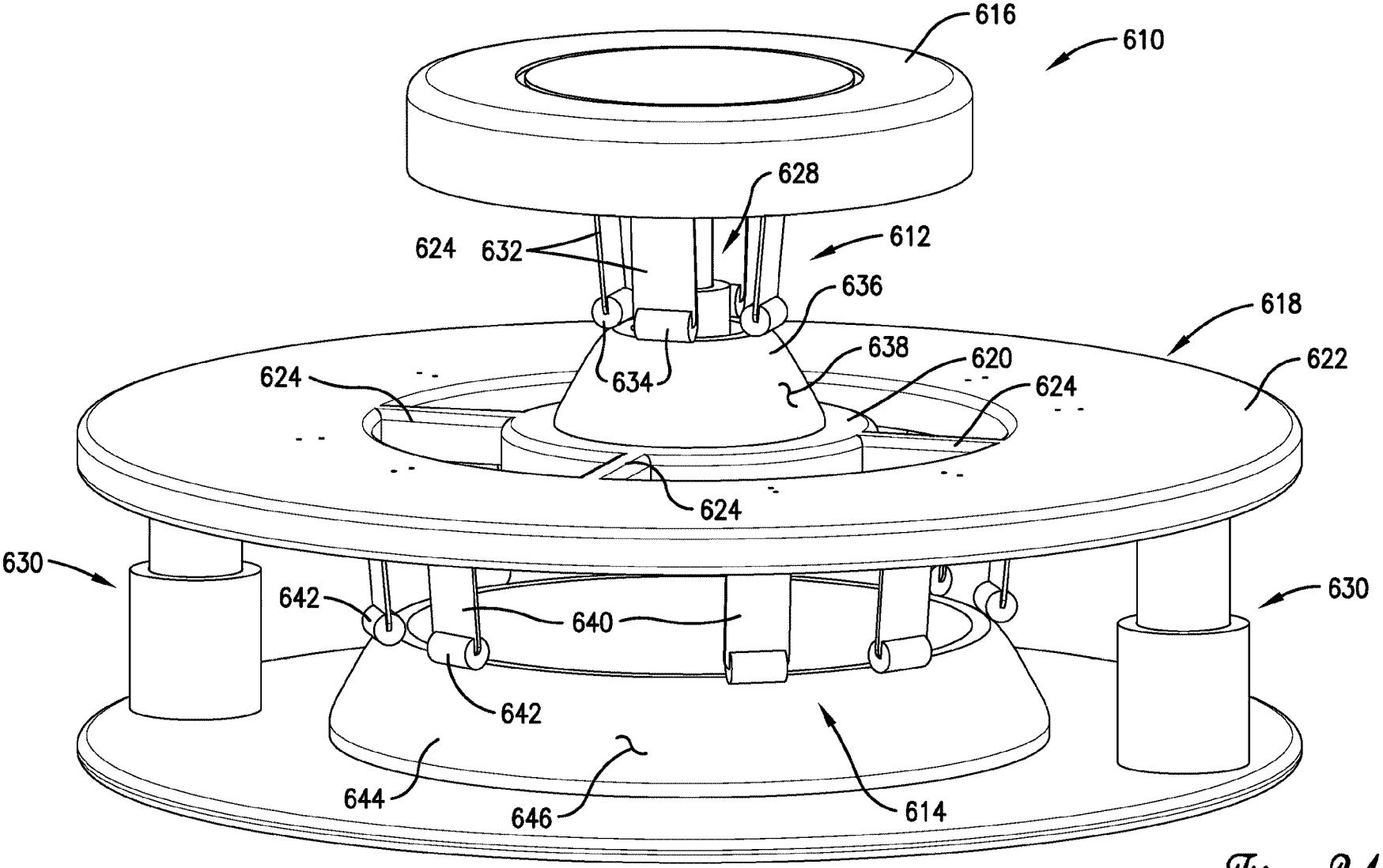
Figure 22:
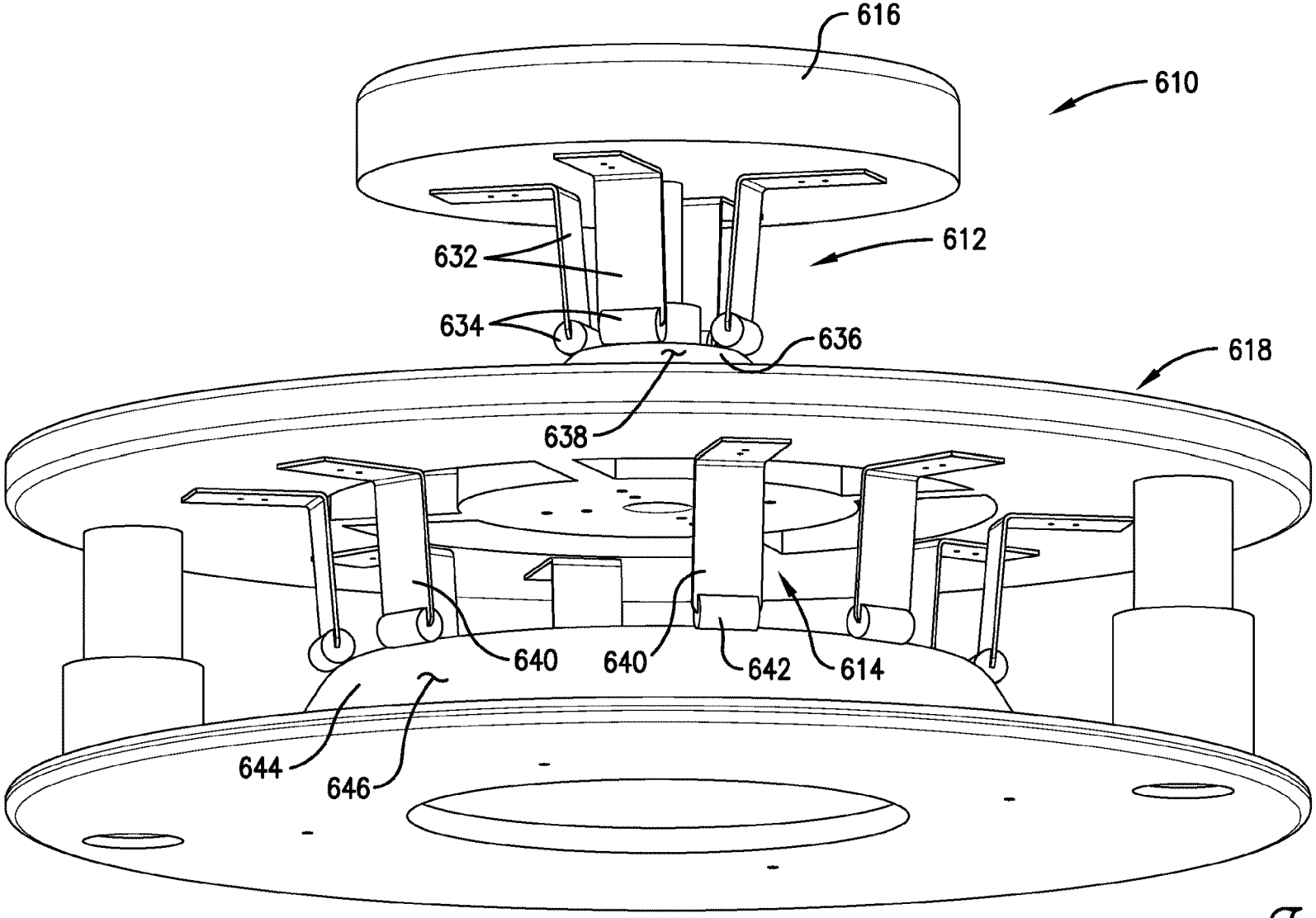
Figure 23:
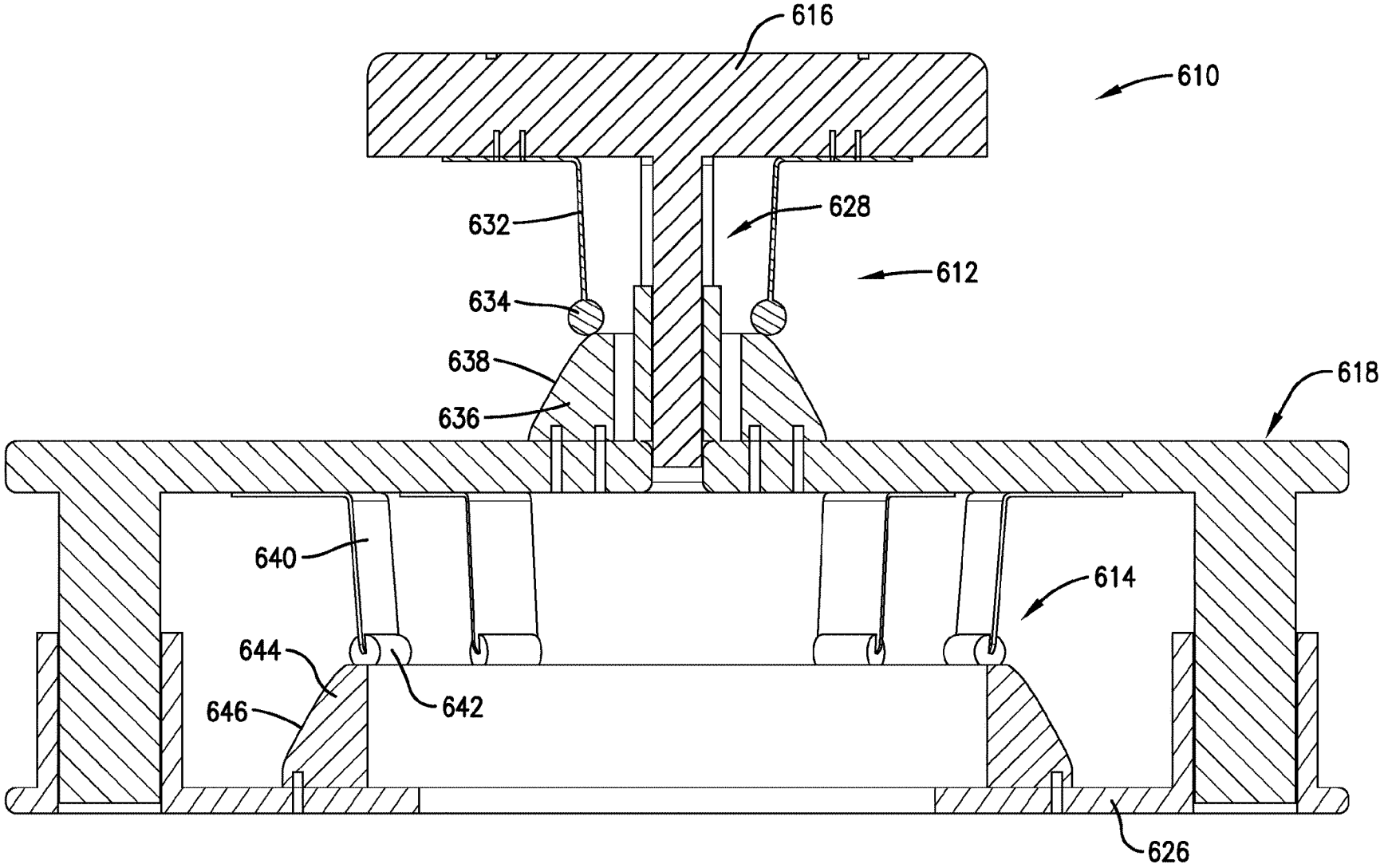
Figure 24:
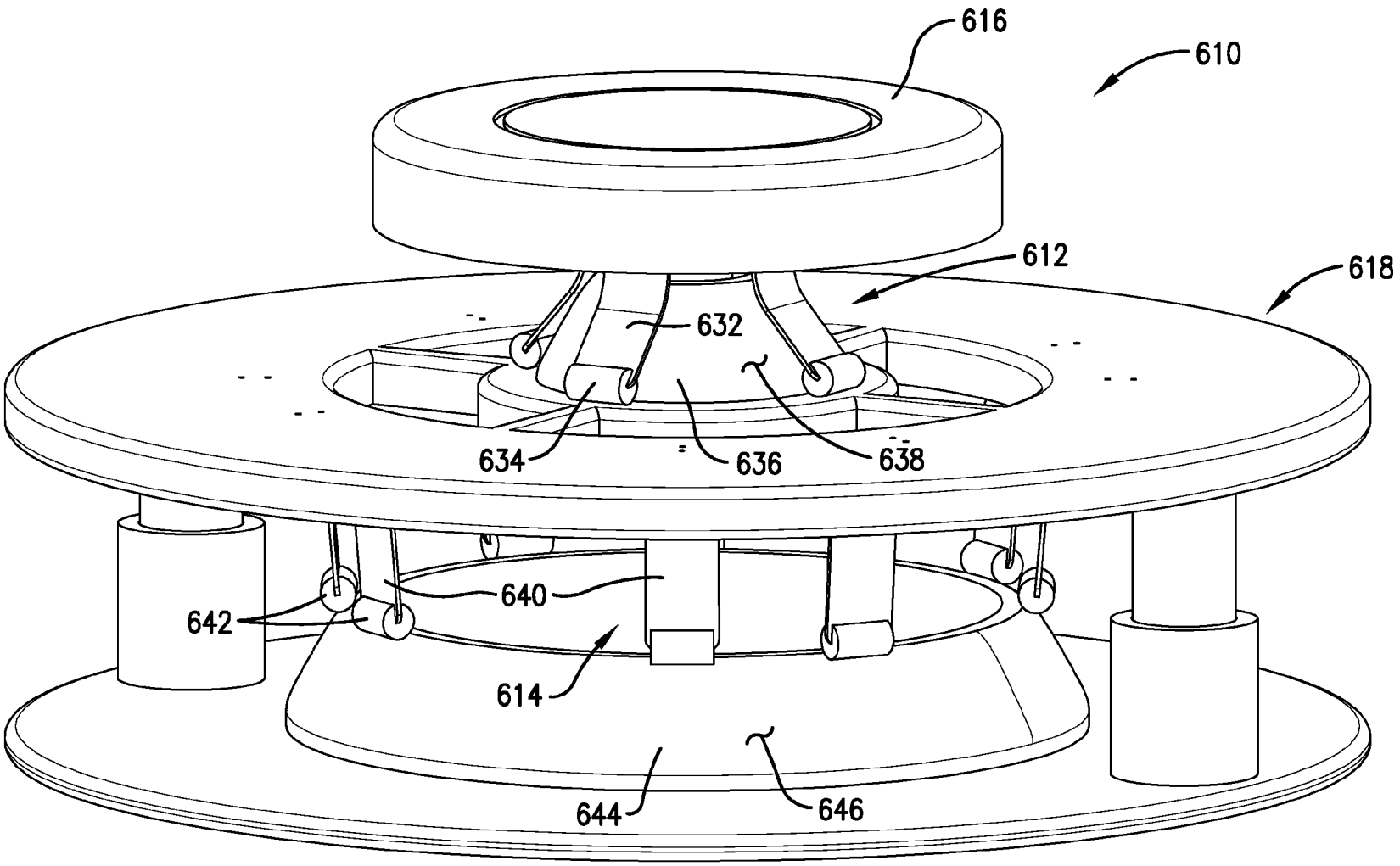
Figure 25:
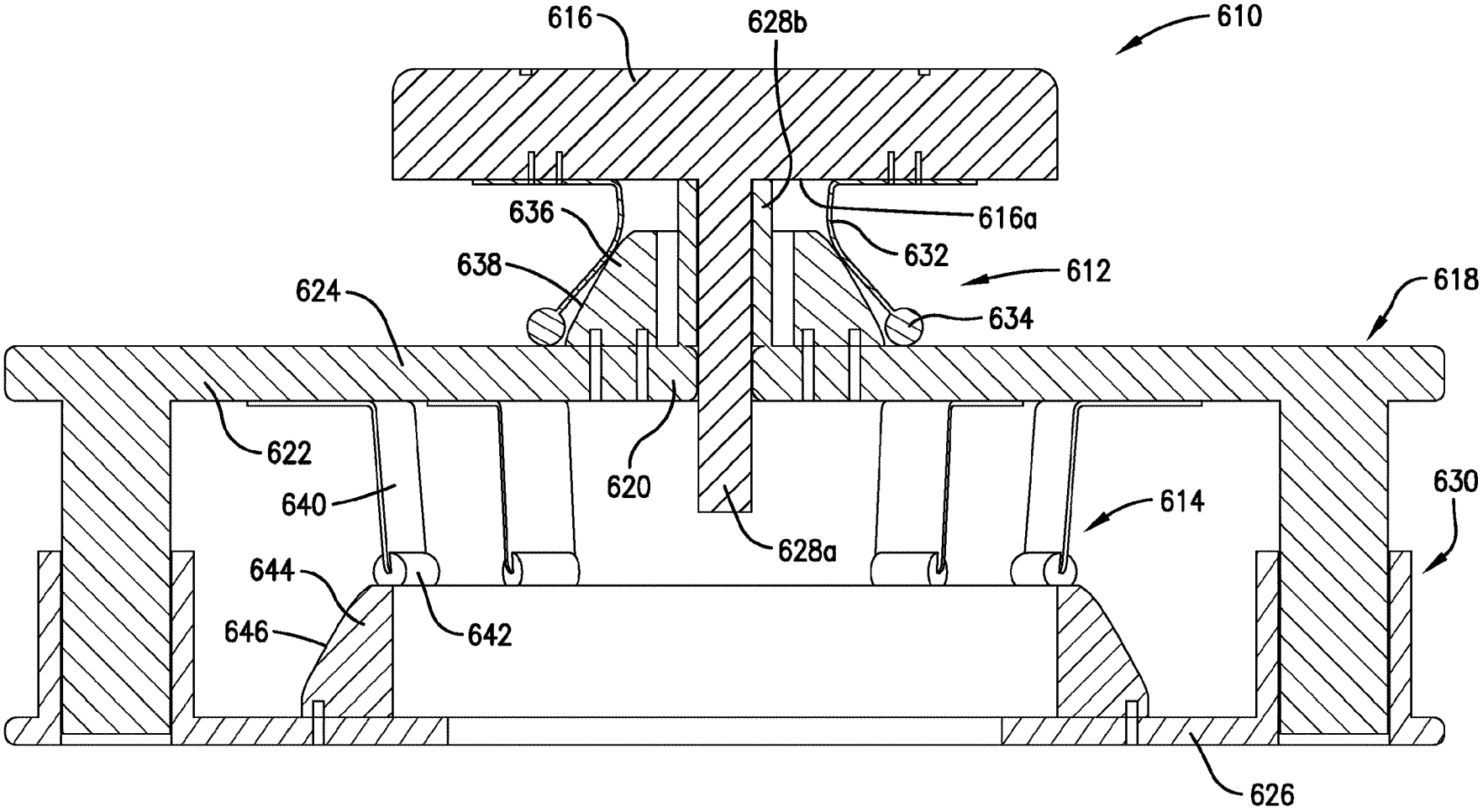

FIG. 4*a* is a detailed view of one of the cam surfaces of the variable resistance device of FIGS. 1-4, particularly illustrating the variable profile thereof;

FIG. 5 is a cross-sectional front view similar to that of FIG. 4 of the variable resistance device of FIGS. 1-4, particularly illustrating the beams thereof in a deflected configuration;

FIG. 6 is a top perspective view of a variable resistance device in accordance with a second preferred embodiment of the present invention, wherein the variable resistance device is configured for use as a shaft centering mechanism;

FIG. 7 is top view of the variable resistance device of FIG. 6, with a shaft assembly supported therein in a centered position such that the beams of the variable resistance device are in an undeflected configuration;

FIG. 8 is top view of the variable resistance device and shaft assembly of FIG. 7, with the shaft assembly having shifted into an off-center position, resulting in deflection of several of the beams and consequent generation of resistance forces acting to re-center the shaft assembly;

FIG. 9 is a perspective view of a variable resistance device in accordance with a third preferred embodiment of the present invention, wherein the variable resistance device is similar to that of the second preferred embodiment except in the split design of the beams thereof;

FIG. 10 is a top view of a variable resistance device in accordance with a fourth preferred embodiment of the present invention, wherein the variable resistance device is configured for use as a chuck element;

FIG. 11 is a top perspective view of a variable resistance device in accordance with a fifth preferred embodiment of the present invention, wherein the variable resistance device is configured for use as a clamp component;

FIG. 12 is a bottom perspective view of the variable resistance device of FIG. 11;

FIG. 13 is an exploded top perspective view of the variable resistance device of FIGS. 11 and 12;

FIG. 14 is a top view of the variable resistance device of FIGS. 11-13;

FIG. 15 is a cross-sectional side view, taken along line 15-15 of FIG. 14, of the variable resistance device of FIGS. 11-14, particularly illustrating the inner and outer beams all in undeflected configurations;

FIG. 16 is a cross-sectional side view similar to that of FIG. 15 of the variable resistance device of FIGS. 11-15, particularly illustrating the inner beams in deflected configurations but the outer beams remaining undeflected;

FIG. 17 is a cross-sectional side view, taken along line 17-17 of FIG. 14, of the variable resistance device of FIGS. 11-16, particularly illustrating both the inner and outer beams in deflected configurations;

FIG. 18 is a top perspective view of a variable resistance device in accordance with a sixth preferred embodiment of the present invention, wherein the variable resistance device is configured for use as a clamp component;

FIG. 19 is a bottom perspective view of the variable resistance device of FIG. 18;

FIG. 20 is an exploded top perspective view of the variable resistance device of FIGS. 18 and 19;

FIG. 21 is a top perspective view of a variable resistance device in accordance with a seventh preferred embodiment of the present invention, wherein the variable resistance device is configured for use as a clamp component;

FIG. 22 is a bottom perspective view of the variable resistance device of FIG. 21;

FIG. 23 is a cross-sectional side view of the variable resistance device of FIGS. 21 and 22;

FIG. 24 is a rotated top perspective view of the variable resistance device of FIGS. 21-23, particularly illustrating completion of a first stage of a sequential deflection process, in which the upper beams are in a deflected configuration but the lower beams remain undeflected; and FIG. 25 is a cross-sectional side view of the variable resistance device of FIGS. 21-24, in the configuration of FIG. 24, particularly illustrating abutment of a lower surface of the upper disk with the guide receiver extending upwardly from the lower plate, upon completion of the first stage of the sequential deflection process.

The drawing figures do not limit the present invention to the specific embodiments disclosed and described herein. While the drawings do not necessarily provide exact dimensions or tolerances for the illustrated structures or components, the drawings are to scale with respect to the relationships between the components of the structures illustrated in the drawings.

DETAILED DESCRIPTION

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

Furthermore, unless specified or made clear, the directional references made herein with regard to the present invention and/or associated components (e.g., top, bottom, upper, lower, inner, outer, etc.) are used solely for the sake of convenience and should be understood only in relation to each other. For instance, a component might in practice be oriented such that faces referred to as "top" and "bottom" are sideways, angled, inverted, etc. relative to the chosen frame of reference.

Conceptual Overview

The various embodiments of the present invention as described below are variable resistance devices configured to generate one or more respective predetermined/desired force or resistance profiles relative to associated deflection of one or more device components. Each generated force profile is dependent on certain key features of the design, including but not limited to the presence of one or more force-generating systems each including at least one deformable beam and an associated cam surface shaped to cause deflection of the beam during operation of the device and, more specifically, during engagement of the particular force-generating system. The shape of the cam surface, the properties of the beam (as at least in part dictated by its size, shape, and material properties), and the interactions between the cam surface and the beam or an interface element associated therewith (e.g., as affected by static and kinetic friction) cooperatively at least in part determine the resistive force output of the device as relates to its deflection.

The predetermined or desired force or resistance profile preferably varies according to the specific application envisioned for a given device. For instance, a device intended for therapeutic use as a hand exerciser might be configured through shaping of the cam surface(s), design of the deflectable beam(s), and so on as noted above to generate a force-deflection profile at least substantially similar to or perhaps instead proportional to the force-deflection profile generated by a representative human hand. The selected profile might also vary by age, gender, or other parameters. Such a device thus facilitates biomechanically appropriate therapeutic approaches to hand therapy and may enable exercises to be completed through the full desired range of motion.

Alternative force profiles might be selected for optimal shaft or bit centering, clamping forces, and so on as appropriate for the given application.

Of course, as will be readily understood by those of ordinary skill in the art, the force-generating system design concepts of the present invention are also readily applicable to other systems or designs, including but not limited to other therapeutic devices, centering mechanisms, chucks, and more in which production of a predetermined or target resistance force profile is desirable.

First Embodiment: Single-System Axial Configuration for a Hand Exerciser

A first embodiment of the present invention is illustrated in FIGS. 1-5. More particularly, a variable resistance device 10 comprises a housing 12 including an upper sliding body 14 and a lower receiving body 16. The device 10 as illustrated is particularly configured for use as a hand exerciser, although other applications (including but not limited to those noted above) are within the ambit of certain aspects of the present invention.

The housing 12 is ergonomically sized and shaped to accommodate comfortable gripping thereof by a human hand. Among other things, for instance, the lower receiving body 16 includes a contoured bottom surface 42 configured to comfortably engage the palm of a user's hand.

The upper sliding body 14 includes a first body element or top 18 and four (4) sides 20 extending at least substantially orthogonally downwardly from the top 18. In contrast, the lower receiving body 16 includes a second body element or base 22 (presenting the aforementioned contoured bottom surface 42) and four (4) sides 24 extending at least substantially orthogonally upwardly from the base 22.

The top 18 and the base 22 are preferably generally elliptically shaped, with the sides 20 and 24 including respective pairs of straight sides 20*a* and 24*a* interconnected by curved sides 20*b* and 24*b*. Thus, the housing 12 has a generally rounded rectangularly cuboidal shape. Alternative shapes (e.g., cylindrical, octagonal, non-rounded rectangular cuboid, etc.) fall within the scope of some aspects of the present invention, however.

In a preferred embodiment, a resiliently deflectable latch element 26 extends downward from each side 20 of the upper sliding body 14. Each latch element 26 includes an elongated, resiliently deflectable body 26*a* extending from the respective side 20 and a laterally outwardly projecting head or catch 26*b* at an end of the body 26*a* and thus spaced from the corresponding side 20.

A pair of latch guides 28 project inwardly from each side 24 of the receiving body 16 and define therebetween a recess 30. Each curved side 24*b* preferably defines a shelf or undercut 30*a* at an upper end of the corresponding recess 30.

The receiving body 16 is preferably oversized relative to the sliding body 14 such that, upon downward linear motion of the sliding body 14 relative to the receiving body 16, increasing portions of the sliding body 14 are received within the receiving body 16. That is, the sliding body 14 is progressively received in the receiving body 16 as the elements 14 and 16 are moved toward one another.

More particularly, in an initial or rest position of the sliding body 14, the heads 26*b* of the latch elements 26 are received in corresponding ones of the recesses 30 and engage the undercuts 30*a*. Such engagement restricts separation of the sliding body 14 and the receiving body 16 but, as will be discussed in greater detail below, allows for further insertion of the sliding body 14 into the receiving body 16.

Preferably, during the course of such further insertion, the latch elements 26 are guided by the guides 28, with the heads 26*b* traveling within the corresponding recesses 30.

As will be apparent to those of ordinary skill in the art, assembly of the housing 12 is made simple by the presence of the latch elements 26, which deflect inward to enable initial insertion of the sliding body into the receiving body 16 to the initial or resting position shown in FIGS. 3 and 4.

As will also be readily apparent to those of ordinary skill in the art, inversion of the above-described latch system in a broad sense is permissible without departing from the scope of the present invention, as is provision of alternative means by which the housing elements engage one another.

In a preferred embodiment, a force-generating system 32 is disposed between the first and second body elements 18 and 22 (i.e., between the top 18 and the base 22). The force-generating system 32 preferably includes a pair of resiliently deflectable beams or followers 34 extending relative to one of said first and second body elements 18 and 22 toward the other of the first and second body elements 18 and 22. In the illustrated embodiment, for instance, a pair of followers or beams 34 extend generally downwardly from the top 18 toward the base 22.

The beams 34 each present upper and lower ends 34*a* and 34*b*, respectively. The beams 34 each also present a distal region 36 spaced from the corresponding upper end 34*a* (and, in turn, from the first body element or top 18) and extending to the corresponding lower end 34*b*. Although a pair of beams is preferred, it is noted that a force-generating system might alternatively include only a single beam or more than a pair of beams.

An interface element 38, preferably in the form of a cylinder or radius, is disposed at the distal region 36 of the respective beam 34. Most preferably, the interface element 38 is provided at the lower end 34*b* of the respective beam or follower 34, although less distal positioning is permissible according to some aspects of the present invention. It is also permissible according to some aspects of the present invention for the interface elements to be omitted entirely.

The beams 34 are preferably identical to one another, as are the interface elements 38, although variations are permissible according to some aspects of the present invention.

The beams 34 are preferably in the form of thin rectangular plates, and the interface elements 38 are preferably cylindrical, as noted above. Other shapes and dimensions fall within the scope of the present invention. However, as will be apparent from further discussion below, certain considerations to beam and interface element design should be made to ensure appropriate functioning of the device 10.

The beams 34 are preferably integrally formed with the top 18, although discrete formation is permissible according to some aspects of the present invention. For instance, the beams might instead by secured to the top via fasteners such as screws, bolts, or latches, or instead be fixed thereto by welding or adhesives.

The beams 34 in the illustrated embodiment may comprise an acetal homopolymer (e.g., Delrin®) or another material well suited for injection molding (e.g., another synthetic resin) and presenting suitable material properties, such as appropriate strength, Young's Modulus, and ratio therebetween. Other materials not suited for injection molding but still presenting suitable material properties may alternatively or additionally be used. For instance, beams or followers comprising steel might be provided in some embodiments.

The force-generating system 32 further preferably includes a cam 40. In a broad sense, the cam 40 preferably projects relative to the other of the first and second body elements 18 and 22. Thus, in the illustrated embodiment, the cam 40 projects axially upwardly from the second body element or receiving body 16.

The cam 40 is preferably integrally formed with the receiving body 16, although non-integral formation is permissible according to some aspects of the present invention.

It is noted that an inversion of the force-generating system, in which the beams project from the second body element and the cam projects from the first body element, is permissible according to some aspects of the present invention. In some instances, a mixed configuration in which one or more beams and/or one or more cams might project from each of the body elements is also permissible.

The cam 40 presents a pair of laterally spaced apart cam surfaces 42. The cam surfaces 42 are preferably identical to one another, although variations are permissible according to some aspects of the present invention.

Each cam surface 42 presents an upper end 42*a* and a lower end 42*b*. In the initial or resting position of the device 10, each interface element 38 rests or nearly rests on a respective cam surface 42 at the upper end 42*a* thereof (see FIG. 4). An interface 44 is thus formed between the interface element 38 and the cam surface 42.

It is noted that substantial initial spacing of the interface elements from the cam surfaces falls within the scope of some aspects of the present invention. Furthermore, it is permissible according to some aspects of the present invention for the interface elements to instead be disposed some distance along the cam surfaces in their initial configurations (i.e., between the upper and lower ends of the respective cam surfaces), rather than having just contacted the upper ends thereof.

The beams 34 preferably angle or taper inwardly in a downward direction, such that the upper ends 34*a* thereof are laterally farther apart from each other than are the lower ends 34*b* (and, in turn, the interface elements 38). However, alternative initial configurations fall within the scope of some aspects of the present invention.

Each cam surface 42 preferably presents a profile that varies along a generally diagonal length thereof (i.e., between the ends 42*a* and 42*b*). That is, the cam surface 42 is preferably neither linear nor circularly arcuate, nor is the cam surface 42 "regular" in another sense.

As shown in FIG. 4*a*, for instance, the cam surface 42 of the illustrated embodiment comprises thirteen (13) distinct segments 46*a-m*, the respective endpoints of which are indicated in FIG. 4*a* by "X" notations and/or the ends 42*a* and 42*b* of the cam surface 42. As is apparent from FIG. 4*a*, each of the distinct segments 46*a-m* is defined by and presents its own characteristic geometry. For instance, various segment lengths, radii of curvature, and so on are present among the distinct segments 46*a-m*. The significance of these distinct segments 46*a-m* will be discussed in greater detail below.

It is noted that irregularity in the context of the cam surface may also apply to only a portion of the profile thereof. That is, it is only necessary for some part of the engageable profile to be irregular, with some or even a majority of the profile being linear, circularly arcuate, etc.

Further still, it is noted that some aspects of the present invention encompass a completely "regular" cam surface profile.

In a broad sense, each interface element 38 is configured to shift along the corresponding cam surface 42 upon application of a driving force to at least one of the body elements 18 and 22 relative to the other of the body elements 18 and 22 and consequent shifting of the body elements 18 and 22 relative to each other. (The location of the interfaces 44 will of course shift as a result.) Shifting of the interface elements 38 along the respective cam surfaces 42 will result in corresponding bending of the respective beams 34 and consequent generation of a resistance force by each beam 34.

With respect to the device 10 of FIGS. 1-5, for instance, and as best illustrated in FIG. 5, application of sufficient vertical force to the first and second body elements 18 and 22 by a user (e.g., sufficient squeezing together of the sliding body 14 and the receiving body 16 via hand or fingers) results in downward and lateral travel of the interface elements 38 along the respective cam surfaces 42. Such travel is also associated with corresponding bending of the beams 34 (such that the lateral distance between the lower ends 34*b* increases).

Resistance to such travel is provided by bending of the beams 34, with the extent of such bending and the forces associated therewith being a function primarily of the geometry of the cam surfaces 42; the dimensioning, shaping, and material properties of the beams 34; the sizing and shaping of the interface elements 38; and the static and kinetic friction forces associated with the interfaces 44 between the interface elements 38 and the cam surfaces 42 (such forces being overcome at the initiation of motion and present after motion has begun, respectively).

Because the cam surfaces 42 present variable profiles, as described above, the resistance forces generated by the respective beams 34 will vary irregularly as the interface elements 38 move along the respective cam surfaces 42.

It is particularly emphasized that the geometry of each cam surface 42 profile, including the individual geometries of the various distinct segments 46*a-m*, is specifically configured to facilitate production by the device 10 of the particular desired resistance force profile (i.e., of the desired resistance force output relative to the axial shifting of the first and second body elements 18 and 22 relative to each other).

That is, as discussed in the conceptual overview above, various parameters associated with the device 10, including the shaping of the cam surfaces 42, the configuration of the beams 24 and interface elements 38, and so on may be chosen to result in a variable resistance force profile corresponding to the varying strength of an exemplary user's hand throughout a gripping motion (or to another desired resistance force profile as appropriate for the particular application).

In the case of the device 10 as illustrated in FIGS. 1-5, the variable mechanical advantage of the hand throughout the gripping motion is accommodated, thereby minimizing trauma to the elements of the hand system in providing a safe mode of exercise. Alternatively stated, the resistance presented by the device 10 varies through the range of motion thereof in such a manner as to correspond to the varying physical capabilities of the hand throughout the hand's associated range of motion.

In a practical sense, the device 10 as configured for exercising of a human hand preferably generates a maximum resistance force of less than about seven (7) lb, more preferably less than about five (5) lb, and most preferably less than about three (3) lb.

The interface elements 38 preferably comprise an acetal homopolymer (e.g., Delrin®) or another material well suited for injection molding (e.g., another synthetic resin), or an alternative material such as steel or aluminum. The cam 40 is preferably likewise formed of one or more of such materials.

Frictional characteristics of the chosen materials for the cam 40 and interface elements 38 relative to each other are of significance in determining the suitability thereof. It is also preferred that scratching or pitting not occur or be minimal during the course of repeated travel of the interface elements 38 along the cam surface 42.

The cam surfaces 42 are preferably identical to one another, as are the beams 34 and the interface elements 38. However, variations between generally comparable elements may also occur within the ambit of certain aspects of the present invention.

As will be readily apparent to those of ordinary skill in the art, and as noted briefly above, the above-described concepts may also be readily applied to other exercise devices. For instance, an exercise apparatus for strengthening a muscle, muscle system, or joint of the body (e.g., back, legs, foot, toe, etc.) may be designed to produce a force-deflection profile corresponding to that of the given muscle, muscle system, or joint and facilitate exercising thereof without over-straining (e.g., without exceeding the desired peak resistance at any given point along the range of motion).

That is, in a broad sense, the present invention may be configured such that the resistance force corresponds to any biologically relevant strength profile.

Non-exercise device applications are also contemplated, with several such embodiments of the present invention being described below.

Second Embodiment: Multi-System Radial Configuration for a Shaft Centering Mechanism A second preferred embodiment of a variable resistance device is illustrated in FIGS. 6-8. It is initially noted that, with certain exceptions to be discussed in detail below, many of the elements of the variable resistance device 110 of the second embodiment are the same as or very similar to those described in detail above in relation to the variable resistance device 10 of the first embodiment. Therefore, for the sake of brevity and clarity, redundant descriptions and numbering will be generally avoided here. Unless otherwise specified, the detailed descriptions of the elements presented above with respect to the first embodiment should therefore be understood to apply at least generally to the second embodiment, as well.

In contrast to the generally linear/axial configuration of the variable resistance device 10, the variable resistance device 110 is arranged generally radially.

More particularly, the variable resistance device 110 includes a substantially circular first body element or frame 112 and a second body element or hub 114 disposed radially inwardly of the frame 112 such that the frame 112 circumscribes the hub 114. The hub 114 defines a central opening 116 therethrough.

It is noted that the frame and other elements may alternatively be polygonal or otherwise shaped without departing from the scope of some aspects of the present invention.

Four (4) force-generating systems 118 are disposed between the frame 112 and the hub 114. More particularly, four (4) cams 120, each presenting a pair of arcuately spaced apart cam surfaces 122, extend radially outwardly from the hub 114. More or fewer force-generating systems might be provided without departing from the scope of the present invention, however.

The cams 120 are preferably evenly arcuately spaced apart, although irregular spacing is permissible according to some aspects of the present invention. Although an even number of cams 120 is illustrated, with the cams 120 being arranged in diametrically opposed pairs, non-paired and/or non-diametrically opposed configurations, as well as configurations including an odd number of cams, fall within the scope of some aspects of the present invention.

Each cam 120 presents a cam surface 122 presenting a variable profile.

The frame 112 includes four (4) reinforcement plates 124. The plates 124 are preferably evenly arcuately spaced apart and provided in diametrically opposed pairs so as to be in radial alignment with corresponding ones of the cams 120. However, as discussed above with regard to the cams, irregularly spaced, non-paired, non-diametrically opposed, and other alternative configurations fall within the scope of some aspects of the present invention.

A pair of followers or beams 126 extends generally radially inwardly from each reinforcement plate 124. An interface element 38 is disposed at a radially inner end of each beam 126 so as to engage a corresponding one of the cams 120. More particularly, in an initial or resting configuration, as shown in FIGS. 6 and 7, each interface element 38 rests or nearly rests on a radially outer end of a corresponding one of the cam surfaces 122.

In keeping with the preferred arrangement of the cams 120 as noted above, the force-generating systems 118 are preferably evenly arcuately spaced. Again, however, it is noted that uneven or otherwise alternative arrangements are permissible according to some aspects of the present invention.

Similarly to those of the variable resistance device 10, the beams 126 and cams 120 of the variable resistance device 110 are designed to produce a pre-determined variable resistance force profile. However, in contrast to the hand exerciser device 10, the variable resistance device 110 is configured for use as a shaft positioner or centering mechanism.

More particularly, as illustrated in FIGS. 7 and 8, a shaft assembly 130 may be rotatably mounted in the hub 114. The shaft assembly 130 in the illustrated embodiment includes a central shaft 132 and a bearing assembly 134 disposed at least in part within the opening 116 defined by the hub 114.

As shown in FIG. 7, when the shaft 132 is perfectly centered, the beams 126 are in an undeflected configuration. That is, each of the force-generating systems 118 is in its initial, undeflected configuration, with the interface elements 128 having not yet begun to travel along the corresponding cam surfaces 122, and no resistance forces being generated. Radial offsetting of the shaft 132 will result in corresponding shifting of the hub 114, however.

For instance, as shown in FIG. 8, radial offsetting of the shaft 132 has resulted in shifting of the hub 114 and, in turn, of the cams 120. Shifting of the cams 120 has resulted in corresponding engagement of selected ones of the interface elements 128 with the corresponding cam surfaces 122. This in turn has resulted in bending of corresponding ones of the beams 126 and generation of resistive forces opposing the offsetting of the shaft 132. The shaft 132 will thus be biased back toward its centered position.

It is particularly noted that the degree to which biasing forces are provided will be in part dependent upon the shape of the cam surfaces 122, with such surfaces being designed to produce a desired resistance force profile to optimally ensure shaft centering while minimizing damage to the shaft, abrupt changes in its position, and so on as required by the particular application. (As noted above, other factors such as beam design, frictional forces, and so on will also influence the output forces.)

As will be readily understood by those of ordinary skill in the art, an initial configuration in which the interface elements are disposed past the ends of the cam surfaces 122 and the beams have already begun to bend is also permissible, with such a configuration providing initial (i.e., preemptive or preventative) resistive forces against off-centering and other positional deviations of the shaft.

It is also noted that the resistive force profiles produced by the various force-generating systems 118 are preferably all identical, as illustrated. However, one or more of the systems 118 may be differently configured to result in a different resistive force profile.

Provision of a different sized or shaped shaft assembly may be facilitated through substitution of a new hub defining an alternatively sized central opening to correspond to a radially outer profile of the given shaft assembly.

According to some aspects of the present invention, a radially configured device at least substantially similar to the device 110 might be used in an application unrelated to shaft centering. Furthermore, although the device 110 might in some embodiments be presented generally independently, as illustrated, it is also permissible for a housing or other supplementary structure(s) to be provided. For instance, the device might be provided as an internal mechanism within a resistive ball such as a stress ball.

It is also noted that a mechanism featuring multiple sets of the device 110 or a similar structure might be formed. For instance, multiple devices 110 might be stacked or aligned axially (e.g., disposed at opposite axial ends of a shaft assembly). In another embodiment, two (2) or more devices 110 might be disposed in intersecting planes (perhaps with some degree of modification to the illustrated design occurring to facilitate such intersection).

Third Embodiment: Alternative Multi-System Radial Configuration for a Shaft Centering Mechanism A third preferred embodiment of a variable resistance device is illustrated in FIG. 9. It is initially noted that, with certain exceptions to be discussed in detail below, many of the elements of the variable resistance device 210 of the third embodiment are the same as or very similar to those described in detail above in relation to the variable resistance devices 10 and 110 of the first and second embodiments. Therefore, for the sake of brevity and clarity, redundant descriptions and numbering will be generally avoided here. Unless otherwise specified, the detailed descriptions of the elements presented above with respect to the first and second embodiments should therefore be understood to apply at least generally to the third embodiment, as well.

Similarly to the variable resistance device 110, the variable resistance device 210 is arranged generally radially and includes a substantially circular frame 212; a hub 214; and a plurality of force-generating systems 216 each including a cam 218, a pair of followers or beams 220, and a respective interface element 222 disposed at a distal region of each beam 220.

In contrast to the solid rectangular plate followers or beams 126 of the variable resistance device 110, however, the beams 220 of the variable resistance device 210 are in the form of split rectangular plates so as to each comprise a pair of longitudinally extending legs 220*a* and 220*b* with a gap or longitudinally extending slit 224 therebetween. Such split configuration facilitates generation of a difference resistance profile than would be achieved by an otherwise equivalently configured but solidly constructed beam.

Fourth Embodiment: Inverted Multi-System Radial Configuration for a Chuck Element A fourth preferred embodiment of a variable resistance device is illustrated in FIG. 10. It is initially noted that, with certain exceptions to be discussed in detail below, many of the elements of the variable resistance device 310 of the fourth embodiment are the same as or very similar to those described in detail above in relation to the variable resistance devices 10, 110, and 210 of the first, second, and third embodiments. Therefore, for the sake of brevity and clarity, redundant descriptions and numbering will be generally avoided here. Unless otherwise specified, the detailed descriptions of the elements presented above with respect to the first, second, and third embodiments should therefore be understood to apply at least generally to the fourth embodiment, as well.

Similarly to the variable resistance devices 110 and 210, the variable resistance device 310 is arranged generally radially. However, the device 310 is generally inverted relative to the devices 110 and 210.

More particularly, the variable resistance device 310 preferably includes a substantially circular frame 312; a hub 314 including a plurality of discrete, arcuately extending, arcuately spaced apart plates 316; and a plurality of force-generating systems 318 each disposed radially between the frame 312 and a corresponding one of the plates 316. Each force-generating system 318 preferably includes a cam 320, a pair of followers or beams 322, and an interface element 324 disposed at a distal region of each beam 322.

However, in contrast to corresponding components of the variable resistance devices 110 and 210, the cams 320 each extend radially inwardly from the frame 312, whereas the beams 322 extend radially outwardly from the plates 316.

As illustrated, the cams 320 are also hollow in construction.

Among other things, the device 310 is well suited for use as a chuck element. For instance, a drill bit or other component may be inserted into an aperture 326 cooperatively defined by the plates 316, with off-center shifting of the drill bit or other inserted component being restricted by resistive forces generated by the beams 322 in a manner similar to that described above in detail with regard to the variable resistance devices 110.

It is particularly noted that the device 310 is readily able to accommodate bits or other components of various outer diameters and/or profiles without replacement of any parts thereof. For instance, a drill bit or inserted component having an outer diameter larger than that of the opening 116 as shown in FIG. 10 would simply shift the plates 316 radially outward to expand the opening 116 and define a new initial position of the plates 316.

Fifth Embodiment: Dual-System Axial Configuration for a Clamp Component

A fifth preferred embodiment of a variable resistance device is illustrated in FIGS. 11-17. It is initially noted that, with certain exceptions to be discussed in detail below, many of the elements of the variable resistance device 410 of the fifth embodiment are the same as or very similar to those described in detail above in relation to the variable resistance devices 10, 110, 210, and 310 of the first through fourth embodiments. Therefore, for the sake of brevity and clarity, redundant descriptions and numbering will be generally avoided here. Unless otherwise specified, the detailed descriptions of the elements presented above with respect to the first through fourth embodiments should therefore be understood to apply at least generally to the fifth embodiment, as well.

As shown in FIGS. 11-17, the variable resistance device 410 includes a centrally disposed first or inner force-generating system 412 and a second or outer force-generating system 414 disposed radially outward of and encircling the first force-generating system 412.

More particularly, the device 410 includes a central disk 416, an outer disk 418 at least substantially (and, in the illustrated embodiment, completely) circumscribing the central disk 416, and a base 420.

The central disk 416 is preferably constrained relative to the base 420 via a central guide 422, and the outer disk 418 is preferably constrained relative to the base 420 via a pair of diametrically opposed outer guides 424. More particularly, each guide 422 or 424 is preferably telescoping in nature and includes a guide peg 422*a* or 424*a* and a receiver 422*b* or 424*b*. The guide pegs 422*a* and 424*a* are preferably slidably received by the corresponding ones of the receivers 422*b* or 424*b* in an at least substantially low-friction manner so as to not substantially alter the forces associated with the first and second force-generating systems.

Most preferably, the pegs 422*a* and 424*a* extend from the respective disks 416 and 418, whereas the receivers 422*b* and 424*b* all extend from the base 420. However, an opposite or varied configuration is also permissible.

It is noted that more or fewer or alternatively positioned guides may also be provided within the ambit of the present invention. Furthermore, any of a variety of alternate means of providing support and guidance of the disks relative to the base may be used without departing from the scope of some aspects of the present invention.

The first or inner force-generating system 412 is preferably disposed axially between the central disk 416 and the base or 420 and includes four (4) evenly arcuately spaced apart inner followers or beams 426 extending generally axially from the central disk 416 toward the base 420; four (4) inner interface elements 428 disposed at respective distal regions of the beams 426; and a hollow-centered, generally toroidal and frustoconical inner cam 430 extending from the base 420 toward the central disk 416. The inner cam 430 presents an arcuately extending, variable profile cam surface 432.

The second or outer force-generating system 414 is preferably disposed axially between the outer disk 418 and the base 420 and includes four (4) evenly arcuately spaced apart pairs of outer followers or beams 434, for a total of eight (8) beams 434, extending generally axially from the outer disk 418 toward the base 420; eight (8) interface elements 436 disposed at respective distal regions of the beams 434; and a hollow-centered, generally toroidal and frustoconical outer cam 438 extending from the base 420 toward the outer disk 418. The outer cam 438 presents an arcuately extending cam surface 440 and circumscribes the inner cam 430.

Each cam surface 432 and 440 preferably presents a variable profile along a generally diagonal length thereof, as described in detail above with regard to other embodiments of the present invention. However, each cam surface 432 and 440 is preferably invariable or unchanging (i.e., consistent) circumferentially (at least to the extent possible given the processes by which the surfaces 432 and 440 are produced). That is, the cam surface 432 preferably presents the same profile arcuately around the circumferential extent of the inner cam 430. The cam surface 440 similarly preferably presents the same profile arcuately around the circumferential extent of the outer cam 438.

However, arcuately varying cam surface shapes/profiles (functionally resulting in circumferentially varying resistance profiles) fall within the scope of some aspects of the present invention. For instance, for a given cam, the profile of a portion of the cam surface engaged by a first interface element might be different from the profile of a different portion of the cam surface as engaged by a second interface element spaced arcuately from the first interface element. For equivalently configured interface elements and beams (and equivalent relative axial displacements of the associated body elements), the generated resistance forces would thus vary based solely on the arcuate variations in the cam profile.

It is noted that alternate numbers of beams are permissible, as are alternate arrangements of the beams (e.g., in terms of spacing, provision or absence of sets, and so on). Furthermore, although the respective inner and outer cams 430 and 438 both preferably extend continuously circumferentially, discontinuous extension is permissible provided adequate engagement capability with the interface elements is maintained. For instance, the continuously circumferentially extending cams could be replaced with a plurality of arcuately extending cam segments.

The variable resistance device 410 is well suited for use as a clamp component. FIG. 15 illustrates the central disk 416 engaging a part P (shown schematically in dashed line) along a first side thereof. A second clamp component, not shown, might engage the part P along the opposite side thereof, such that the part P is clamped between the variable resistance device 410 and the second clamp component.

In FIG. 15, the clamping forces are low enough that deformation of the inner beams 426 of the inner or first force-generating system 412 has not yet occurred. However, in FIG. 16, increased clamping forces have resulted in downward shifting of the central disk 416 (as guided by sliding of the peg 422*a* through the receiver 422*b*) and consequent travel of the inner interface elements 428 along the cam surface 432. The inner beams 426 have deformed as a result, generating a resistance force against further shifting of the part P and the central disk 416.

It is particularly noted that, in FIG. 16, the part P has just begun to additionally engage the outer disk 418 but has not yet begun to transfer force thereto. However, in FIG. 17, continued pressure against the part P from the second clamp component (not shown) has caused the second or outer force-generating system 414 to engage as well (i.e., in addition to the still-active first or inner force-generating system 412). That is, in the state illustrated in FIG. 17, both the central disk 416 and the outer disk 418 are shifting axially downward, with the inner and outer beams 426 and 434 all deflecting as the respective interface elements 428 and 436 travel along the respective cam surfaces 432 and 440.

Shifting of the disks 416 and 418 will cease upon bottoming out of the central disk 416 against the central receiver 424*b*. That is, a lower surface 416*a* of the central disk 416 will engage the upper end of the central receiver 424*b*.

As will be readily apparent to those of ordinary skill in the art, the resistance forces generated by the device 410 are highly customizable to best suit a given application as a result of the sequential engagement of the first and second systems 412 and 414, as well as by the general variability of the cam surfaces 432 and 440 and the ability to customize the beams 426 and 434 and interface elements 428 and 436 themselves.

It is also noted that, in some instances, a part might be clamped using only one of the systems 412 and 414 (or, alternatively stated, via engagement with only one of the central and outer disks 416 and 418). A narrow rod of small diameter might engage only the central disk, for instance, or a large hollow shaft might circumscribe the central disk and instead engage only the outer disk.

It is also permissible for interconnecting or force-transfer means to be built into the variable resistance device to ensure engagement of both the inner and outer force-generating systems thereof. For instance, one or more stepped brackets might extend between and interconnect the central and outer disks such that axial displacement of either of the disks causes corresponding axial displacement of the other of the disks. In a broad sense, any of a variety of means of operationally linking two (2) or more force-generating systems are permissible.

Furthermore, although the illustrated configuration presents a generally round outer perimeter and similarly arcuately arranged or configured components, any of a variety of general shapes fall within the scope of the present invention.

Sixth Embodiment: Multi-System Axial Configuration for a Clamp Component

A sixth preferred embodiment of a variable resistance device is illustrated in FIGS. 18-20. It is initially noted that, with certain exceptions to be discussed in detail below, many of the elements of the variable resistance device 510 of the sixth embodiment are the same as or very similar to those described in detail above in relation to the variable resistance devices 10, 110, 210, 310, and 410 of the first through fifth embodiments. Therefore, for the sake of brevity and clarity, redundant descriptions and numbering will be generally avoided here. Unless otherwise specified, the detailed descriptions of the elements presented above with respect to the first through fifth embodiments should therefore be understood to apply at least generally to the sixth embodiment, as well.

As shown in FIGS. 18-20, the variable resistance device 510 includes a centrally disposed first force-generating system 512 and arcuately distributed second, third, fourth, and fifth force-generating systems 514, 516, 518, and 520 disposed radially outward of and cooperatively encircling the first force-generating system 512.

The device 510 also includes a central disk 522 and four (4) arcuately extending outer plates 524 cooperatively encircling the central disk 522. A base 526 is also provided. The plates 524 are preferably arranged in pairs rather than being evenly spaced apart or randomly distributed. However, non-paired configurations fall within the scope of the present invention.

The central disk is preferably constrained relative to the base 526 via a central guide 528. However, in the illustrated embodiment, the outer plates 524 are not provided with guides but are instead supported relative to the central disk 522 by respective radially extending pins 530 that extend into corresponding apertures 532 in the central disk 522. In this manner, relative axial movement of the central disk 522 and the various plates 524 is restricted. Alternatively stated, engagement of various force-generating systems 512, 514, 516, 518, and 520 occurs at least substantially simultaneously in the illustrated configuration.

However, is particularly noted that the variable resistance device 510 enables easy removal or one or more of the outer systems 514, 516, 518, and 520 simply via removal of the associated one of the pins 530 from the corresponding aperture 532. That is, the device 510 is inherently exceptionally flexible in its configuration.

It is also noted that the pins may be integrally formed with the central disk or any of the plates, or the pins may instead be discrete components able to be removed entirely from the device.

Pins might extend between adjacent ones of the plates in addition to or instead of extending to and from the central disk, as well. Brackets of other interconnecting elements might alternatively or additionally be provided between some or all of the disk and plates, as well.

Still further, it is noted that alternative axial support or guide systems, including but not limited to telescoping guides at least substantially similar to the central guide, may be additionally or alternatively associated with the outer (i.e., second through fourth) force-generating systems without departing from the scope of the present invention.

The first force-generating system 512 is preferably disposed between the central disk 522 and the base 526 and includes four (4) evenly arcuately spaced apart inner followers or beams 534 extending generally axially from the central disk 522 toward the base 526; four (4) inner interface elements 536 disposed at respective distal regions of the inner beams 534; and a hollow-centered, generally toroidal and frustoconical inner cam 538 extending from the base 526 toward the central disk 522 and presenting an arcuately extending, variable profile cam surface 540.

The second and third force-generating systems 514 and 516 are preferably diametrically opposed to one another, identically configured, and disposed between respective plates 524 and the base 526. More particularly, each of the second and third force-generating systems 514 and 516 preferably includes two (2) followers or beams 544 extending generally axially from the respective plate 524 toward the base 526; two (2) interface elements 546 disposed at respective distal regions of the beams 542; and axially aligned portions of a hollow-centered, generally toroidal and frustoconical outer cam 546 extending from the base 526 toward the various plates 524. The outer cam 546 presents an arcuately extending, variable profile cam surface 548 and circumscribes the inner cam 538.

The fourth and fifth force-generating systems 518 and 520 are preferably diametrically opposed to one another, identically configured, and disposed between respective plates 524 and the base 526. More particularly, each of the fourth and fifth force-generating systems 518 and 520 preferably includes three (3) followers or beams 550 extending generally axially from the respective plate 524 toward the base 526; three (3) interface elements 552 disposed at respective distal regions of the beams 550; and axially aligned portions of the aforementioned outer cam 546.

The variable resistance device 510 is well suited for use as a clamp component in a manner at least generally similar to that of the variable resistance device 410 of the fifth embodiment. However, the provision of a greater number of distinct force-generating systems 512, 513, 516, 518, and 520 provides the variable resistance device 510 with even greater flexibility than that afforded by the variable resistance device 410. For example, anywhere from one (1) to five (5) force-generating systems might be simultaneously engaged; only force-generating systems having three (3) beams could be utilized; or each of the five (5) force-generating systems could be configured to generate its own unique resistance force profile through variations in the number of beams, beam geometries, interface element geometries, cam surface profiles, etc.

Seventh Embodiment: Stacked Axial Configuration for a Clamp Component

A seventh preferred embodiment of a variable resistance device is illustrated in FIGS. 21-25. It is initially noted that, with certain exceptions to be discussed in detail below, many of the elements of the variable resistance device 610 of the seventh embodiment are the same as or very similar to those described in detail above in relation to the variable resistance devices 10, 110, 210, 310, 410, and 510 of the first through sixth embodiments. Therefore, for the sake of brevity and clarity, redundant descriptions and numbering will be generally avoided here. Unless otherwise specified, the detailed descriptions of the elements presented above with respect to the first through sixth embodiments should therefore be understood to apply at least generally to the seventh embodiment, as well.

As shown in FIGS. 21-25, the variable resistance device 610 includes a centrally and upwardly disposed first or upper force-generating system 612 and a second or lower force-generating system 614 at least substantially disposed radially outward of and below the first force-generating system 612.

The device 610 also includes an upper disk 616; a lower plate 618 including an inner disk 620, a toroidal outer disk 622 at least substantially circumscribing the inner disk 620, and a plurality of radial struts 624 extending between and interconnecting the inner and outer disks 620 and 622; and a base 626.

The upper disk 616 is preferably constrained relative to the lower plate 618 (and, more particularly, the inner disk 620 thereof) via a central guide 628. The central guide 628 preferably includes a guide peg 628*a* extending axially downwardly from the upper disk 616 and a receiver 628*b* extending axially upwardly from the inner disk 620 of the lower plate 618.

The outer disk 622 (and, more broadly, the lower plate 618) is preferably constrained relative to the base 626 by a pair of diametrically opposed outer guides 630 at least substantially similar in configuration to the central guide 628.

The first or upper force-generating system 612 is preferably disposed between the upper disk 616 and the inner disk 620 of the lower plate 618. More particularly, the first or upper force-generating system 612 preferably includes four (4) evenly arcuately spaced apart upper followers or beams 632 extending generally axially from the upper disk 616 toward the inner disk 620; four (4) upper interface elements 634 disposed at respective distal regions of the beams 632; and a hollow-centered, generally toroidal and frustoconical upper cam 636 extending from the inner disk 620 toward the upper disk 616 and presenting an arcuately extending, variable profile cam surface 638.

The second or lower force-generating system 614 is preferably disposed between the lower plate 618 and the base 626. More particularly, the second or lower force-generating system 614 preferably includes four (4) pairs of evenly arcuately spaced apart lower followers or beams 640 (for a total of eight (8) beams 640) extending generally axially from the outer disk 622 toward the base 626; eight (8) lower interface elements 642 disposed at respective distal regions of the beams 640; and a hollow-centered, generally toroidal and frustoconical lower cam 644 extending from the base 626 toward the lower plate 618 and presenting an arcuately extending, variable profile cam surface 646.

The variable resistance device 610 is well suited for use as a clamp component in a manner at least generally similar to that of the variable resistance devices 410 and 510 of the fifth and sixth embodiments. However, the device 610 is particularly well suited for use in a sequential engagement scenario.

For instance, initial application of force to the upper disk 616 results in downward shifting of the upper disk 616 and engagement of the first force-generating system 612, causing deflection of the upper beams 632 and associated generation of a variable resistance force thereby. As shown in FIGS. 24 and 25, sufficient downward travel of the upper disk 616 results in engagement of a lower surface 616*a* thereof with the receiver 628*b* of the central guide 628. Further axially downward forces applied to the upper disk 616 will be transmitted through the receiver 628*b* to the lower plate 618. If the transmitted forces are of sufficient magnitude, this will result in downward shifting of the lower plate 618 and consequent engagement of the second or lower force-generating system 614.

Of course, as will be readily understood by those of ordinary skill in the art, other sequential and non-sequential engagement scenarios might also be facilitated by the device 610.

It is particularly noted that the relative resistances generated by the first and second systems 612 and 614 may be non-equal (e.g., so that resistance is greater or lesser in the second stage of depression), although at least substantially equivalent resistance force outputs could also be provided without departing from the scope of the present invention.

It is also noted that, although the method described above features two (2) sequential steps or stages each occurring non-contemporaneously, partial or full overlapping motion of the systems 612 and 614 (i.e., at least some simultaneous operation of the systems 612 and 614) is also permissible. For instance, transfer of sufficient force to the lower plate from the upper beams themselves and thereafter through the upper cam might occur to drive concurrent axial shifting of the lower plate prior to "bottoming out" of the upper disk.

Still further, devices configured to include additional sequential shifts (e.g., through the provision of additional axially stacked systems) are contemplated.

CONCLUSION

The preferred forms of the invention described above are to be used as illustration only and should not be utilized in a limiting sense in interpreting the scope of the present invention. Obvious modifications to the exemplary embodiments, as hereinabove set forth, could be readily made by those skilled in the art without departing from the spirit of the present invention.

Although the above description presents features of preferred embodiments of the present invention, other preferred embodiments may also be created in keeping with the principles of the invention. Furthermore, as noted previously, these other preferred embodiments may in some instances be realized through a combination of features compatible for use together despite having been presented independently as part of separate embodiments in the above description.

The inventors hereby state their intent to rely on the Doctrine of Equivalents to determine and access the reasonably fair scope of the present invention as pertains to any apparatus not materially departing from but outside the literal scope of the invention.

What is claimed is:

1. A variable resistance device configured to generate a variable resistance force, said variable resistance device comprising:

a first body element;

a second body element; and a force-generating system disposed between said first and second body elements, said force-generating system including a resiliently deflectable beam, an interface element, and a cam, said resiliently deflectable beam extending relative to the first body element and toward the second body element, said resiliently deflectable beam presenting a distal region spaced from the first body element, said interface element being disposed at the distal region of the resiliently deflectable beam, said cam projecting relative to the second body element and toward the first body element, said cam presenting a variable cam surface, said interface element configured to shift along the cam surface upon application of a driving force to at least one of said first and second body elements relative to the other of said first and second body elements and consequent shifting of said first and second body elements relative to each other, wherein shifting of said interface element along the cam surface results in corresponding bending of the resiliently deflectable beam and consequent generation of a resistance force by said resiliently deflectable beam, said cam surface presenting a variable, irregular engagement profile that varies irregularly along a length thereof, such that the interface element moves irregularly along the variable, irregular engagement profile upon application of the driving force, and such that the resistance force generated by the resiliently deflectable beam varies irregularly as the interface element moves irregularly along the variable, irregular engagement profile.

2. The variable resistance device of claim 1, said variable resistance device comprising a plurality of said force-generating systems.

3. The variable resistance device of claim 2, said force-generating systems including a central force-generating system and an outer force-generating system, said outer force-generating system at least in part circumscribing the central force-generating system.

4. The variable resistance device of claim 3, said force-generating systems including a plurality of said outer force-generating systems, said outer force-generating systems cooperatively at least in part circumscribing the central force-generating system.

5. The variable resistance device of claim 2, said force-generating systems including a diametrically opposed pair of force-generating systems.

6. The variable resistance device of claim 2, said force-generating systems being evenly arcuately distributed.

7. The variable resistance device of claim 2, said variable resistance device defining an axis, said force-generating systems including an upper force-generating system and a lower force-generating system, said upper force-generating system being disposed axially above said lower force-generating system.

8. The variable resistance device of claim 2, said force-generating systems being operationally linked such that said force-generating systems operate at least in part sequentially.

9. The variable resistance device of claim 2, said force-generating systems being operationally linked such that said force-generating systems operate at least in part contemporaneously.

10. The variable resistance device of claim 1, said variable resistance device defining an axis, said first and second body elements being radially shiftable relative to each other.

11. The variable resistance device of claim 10, one of said first and second body elements comprising a hub, the other of said first and second body elements comprising a frame circumscribing said hub.

12. The variable resistance device of claim 1, said force-generating system including a plurality of said resiliently deflectable beams and a plurality of said interface elements.

13. The variable resistance device of claim 12, said cam presenting a plurality of said cam surfaces.

14. The variable resistance device of claim 1, said profile including a plurality of distinct segments, each of said distinct segments being defined by and presenting a distinct characteristic geometry.

15. The variable resistance device of claim 14, at least one of said distinct segments being neither linear nor circularly arcuate.

16. The variable resistance device of claim 1, said variable resistance device defining an axis, said first and second body elements being axially shiftable relative to each other.

17. The variable resistance device of claim 1, said resiliently deflectable beam comprising a rectangular plate.

18. The variable resistance device of claim 1, said interface element comprising a cylinder.

19. The variable resistance device of claim 1, said variable resistance device configured such that the resistance force corresponds to a biologically relevant strength profile.

20. The variable resistance device of claim 1, said variable resistance device configured for use as at least one of a hand exerciser, a shaft centering mechanism, a chuck element, and a clamp component.

21. The variable resistance device of claim 1, said resistance force generated by the resiliently deflectable beam increasing prior to decreasing, as the interface element moves along the variable, irregular engagement profile of the cam surface.

22. The variable resistance device of claim 1, said variable, irregular engagement profile of the cam surface including a less-sloped segment preceding a segment having a more-sloped segment, such that the resiliently deflectable beam generates a relatively larger resistance force prior to generating a relatively smaller resistance force.

* * * * *